US011404763B2

(12) United States Patent
Park et al.

(10) Patent No.: US 11,404,763 B2
(45) Date of Patent: Aug. 2, 2022

(54) ANTENNA MODULE AND ELECTRONIC DEVICE INCLUDING THE SAME

(71) Applicant: Samsung Electronics Co., Ltd., Gyeonggi-do (KR)

(72) Inventors: Seongjin Park, Gyeonggi-do (KR); Dongyeon Kim, Gyeonggi-do (KR); Sehyun Park, Gyeonggi-do (KR); Sumin Yun, Gyeonggi-do (KR); Myunghun Jeong, Gyeonggi-do (KR); Jehun Jong, Gyeonggi-do (KR); Jaehoon Jo, Gyeonggi-do (KR)

(73) Assignee: Samsung Electronics Co., Ltd.

( * ) Notice: Subject to any disclaimer, the term of this patent is extended or adjusted under 35 U.S.C. 154(b) by 155 days.

(21) Appl. No.: 16/791,377

(22) Filed: Feb. 14, 2020

(65) Prior Publication Data

US 2020/0266523 A1 Aug. 20, 2020

(30) Foreign Application Priority Data

Feb. 14, 2019 (KR) ..... 10-2019-0017385

(51) Int. Cl.
*H01Q 9/28* (2006.01)
*H01Q 1/24* (2006.01)
(Continued)

(52) U.S. Cl.
CPC ..... *H01Q 1/243* (2013.01); *H01Q 1/48* (2013.01); *H01Q 21/062* (2013.01)

(58) Field of Classification Search
CPC ..... H01Q 1/243; H01Q 1/48; H01Q 21/062; H01Q 5/371; H01Q 9/16; H01Q 1/2283;
(Continued)

(56) References Cited

U.S. PATENT DOCUMENTS 4,205,317 A 5/1980 Young
5,039,994 A 8/1991 Wash et al.
(Continued)

FOREIGN PATENT DOCUMENTS

EP 2 091 103 8/2009

OTHER PUBLICATIONS

International Search Report dated Jun. 11, 2020 issued in counterpart application No. PCT/KR2020/002170, 3 pages.
(Continued)

*Primary Examiner* — Dimary S Lopez Cruz
*Assistant Examiner* — Bamidele A Jegede
(74) *Attorney, Agent, or Firm* — The Farrell Law Firm, P.C.

(57) ABSTRACT

An electronic device is provided, which includes an antenna structure disposed inside housing and including a first surface facing a first direction and a second surface facing a direction opposite to the first direction. When viewed from above the first surface, the antenna structure may include a first region including a periphery extending in a second direction perpendicular to the first direction and including at least one ground layer, a second region contacting the periphery, a first dipole antenna extending in the second direction and spaced from the periphery, within the second region when viewed from above the first surface, a second dipole antenna extending in the second direction between the periphery and the first dipole antenna, and at least one conductive pattern interposed between the periphery and the second dipole antenna.

16 Claims, 19 Drawing Sheets

(51) Int. Cl.
*H01Q 1/48* (2006.01)
*H01Q 21/06* (2006.01)

(58) Field of Classification Search
CPC ..... H01Q 21/28; H01Q 21/08; H01Q 9/065; H01Q 9/285; H01Q 21/065; H04M 1/0249; H04M 1/0266; H04M 1/0277
See application file for complete search history.

(56) References Cited

U.S. PATENT DOCUMENTS 8,094,082 B2 * 1/2012 Rudant ..... H01Q 1/48 343/725
8,558,748 B2 10/2013 Chen et al.
8,760,352 B2 * 6/2014 Rao ..... H01Q 21/28 343/702
9,093,758 B2 * 7/2015 Kish ..... H01Q 21/205
9,306,291 B2 * 4/2016 Lu ..... H01Q 1/525
9,666,954 B2 5/2017 Ko et al.
9,806,422 B2 10/2017 Garcia et al.
9,819,098 B2 * 11/2017 Gu ..... H01Q 25/00
9,917,368 B2 3/2018 Garcia et al.
9,984,985 B1 * 5/2018 Chiang ..... H01L 23/585
10,431,892 B2 10/2019 Garcia et al.
10,608,336 B2 3/2020 Chen et al.
10,790,573 B2 * 9/2020 Kim ..... H01Q 21/065
2006/0071864 A1 4/2006 Richard et al.
2006/0139209 A1 * 6/2006 Tanaka ..... H01Q 19/22 343/700 MS
2007/0069957 A1 * 3/2007 Ranta ..... H01Q 1/243 343/700 MS
2008/0030418 A1 * 2/2008 Brachat ..... H01Q 9/285 343/810
2009/0207092 A1 8/2009 Nysen et al.
2011/0090131 A1 * 4/2011 Chen ..... H01Q 19/30 343/815
2011/0136447 A1 * 6/2011 Pascolini ..... H01Q 1/243 343/702
2013/0300602 A1 * 11/2013 Zhou ..... H01Q 21/005 342/372
2014/0097993 A1 * 4/2014 Hotta ..... H01Q 1/243 343/702
2015/0002367 A1 * 1/2015 Kosaka ..... H01Q 9/42 343/893
2015/0070228 A1 * 3/2015 Gu ..... H01Q 25/00 343/727
2015/0097993 A1 * 4/2015 Oniki ..... G06T 5/004 348/241
2016/0056544 A1 2/2016 Garcia et al.
2016/0072539 A1 * 3/2016 Hu ..... H04B 1/3888 455/575.8
2016/0079653 A1 * 3/2016 Kanj ..... H01Q 1/521 343/702
2016/0087348 A1 * 3/2016 Ko ..... H01Q 1/521 455/73
2016/0172761 A1 6/2016 Garcia et al.
2017/0229769 A1 * 8/2017 Yokoyama ..... H01L 21/78
2017/0317418 A1 11/2017 Garcia et al.
2017/0317420 A1 11/2017 Farzaneh et al.
2017/0346185 A1 * 11/2017 Wang ..... H01Q 9/065
2018/0076526 A1 3/2018 Garcia et al.
2018/0090826 A1 * 3/2018 Da Costa Bras Lima ..... H01Q 9/04
2018/0288203 A1 * 10/2018 Jeon ..... H01Q 9/42
2019/0006751 A1 * 1/2019 Chen ..... H01Q 1/48
2019/0027807 A1 * 1/2019 Choi ..... H01Q 1/243
2019/0027808 A1 * 1/2019 Mow ..... H04R 1/025
2019/0267710 A1 * 8/2019 Jenwatanavet ..... H01Q 21/065
2019/0319341 A1 * 10/2019 Park ..... H01Q 1/243
2020/0203804 A1 * 6/2020 Khripkov ..... H01Q 9/0485
2021/0021039 A1 * 1/2021 Kim ..... H01L 23/66

OTHER PUBLICATIONS

European Search Report dated Oct. 29, 2021 issued in counterpart application No. 20755468.4-1205, 15 pages.

* cited by examiner

ANTENNA MODULE AND ELECTRONIC DEVICE INCLUDING THE SAME

CROSS-REFERENCE TO RELATED APPLICATION(S)

This application is based on and claims priority under 35 U.S.C. § 119 to Korean Patent Application No. 10-2019-0017385, filed on Feb. 14, 2019, in the Korean Intellectual Property Office, the entire disclosure of which is incorporated herein by reference.

BACKGROUND

1. Field

The disclosure relates generally to an antenna module and an electronic device including the same.

2. Description of Related Art

An electronic device equipped with an antenna, such as a smartphone or a wearable device, is commonly available. The electronic device may receive or transmit a signal including data (e.g., a message, a photo, a video, a music file, or a game) through the antenna.

The antenna of the electronic device may be implemented using a plurality of antenna elements for receiving or transmitting a signal more efficiently. For example, the electronic device may include one or more antenna arrays in each of which a plurality of antenna elements are arranged in a regular shape.

To improve data throughput, a wireless signal in a relatively high frequency band may be used. Because the antenna may have different physical characteristics depending on the frequency of a signal, different antennas may be used depending on the used frequency band. For example, an electronic device may use different antennas for a signal having a frequency below 6 GHz and a signal having the frequency above 6 GHz.

To receive high-frequency signals (e.g., signals with frequencies above 6 GHz), a plurality of antenna modules may be positioned in the electronic device such that the reception coverage of the electronic device is capable of covering the omnidirectional range of the electronic device. However, an electronic device may have the limited mounting space due to the miniaturization and multifunction of the electronic device. For example, the size of the electronic device may be limited due to the size of the antenna module.

SUMMARY

The disclosure is provided to address at least the above-mentioned problems and/or disadvantages and to provide at least the advantages described below.

Accordingly, an aspect of the disclosure is to provide an antenna module having reduced size and an electronic device including the same.

In accordance with an aspect of the disclosure, an electronic device includes a housing including a first plate, a second plate facing away from the first plate, and a side member surrounding a space between the first plate and the second plate; a display; an antenna structure disposed inside the housing, wherein the antenna structure includes a first surface facing a first direction, a second surface facing a direction opposite to the first direction, when viewed from above the first surface, a first region including a periphery extending in a second direction perpendicular to the first direction and including a ground layer, a second region contacting the periphery, when viewed from above the first surface, a first dipole antenna extending in the second direction and spaced from the periphery, within the second region, a second dipole antenna extending in the second direction between the periphery and the first dipole antenna, and a conductive pattern interposed between the periphery and the second dipole antenna; and a wireless communication circuit electrically connected to at least one of the first dipole antenna or the second dipole antenna, wherein the wireless communication circuit is configured to transceive signals having frequencies between 3 GHz and 100 GHz.

In accordance with another aspect of the disclosure, an electronic device includes a housing including a first plate, a second plate facing away from the first plate, and a side member surrounding a space between the first plate and the second plate; a display; an antenna structure disposed inside the housing, wherein the antenna structure includes a first surface facing a first direction, a second surface facing a direction opposite to the first direction, when viewed from above the first surface, a first region including a periphery extending in a second direction perpendicular to the first direction and including ground layer, a second region contacting the periphery, a dipole antenna extending in the second direction and spaced from the periphery, within the second region, and a conductive pattern interposed between the periphery and the dipole antenna; and a wireless communication circuit electrically connected to the dipole antenna, wherein the wireless communication circuit is configured to transceive signals having frequencies between 3 GHz and 100 GHz.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Hereinafter, various embodiments of the disclosure are described with reference to accompanying drawings. The embodiments and terms used with regard to the disclosure are not intended to limit the technology described herein to specific embodiments, and should be understood to include various modifications, equivalents, and/or alternatives of the embodiments.

Figure 1:
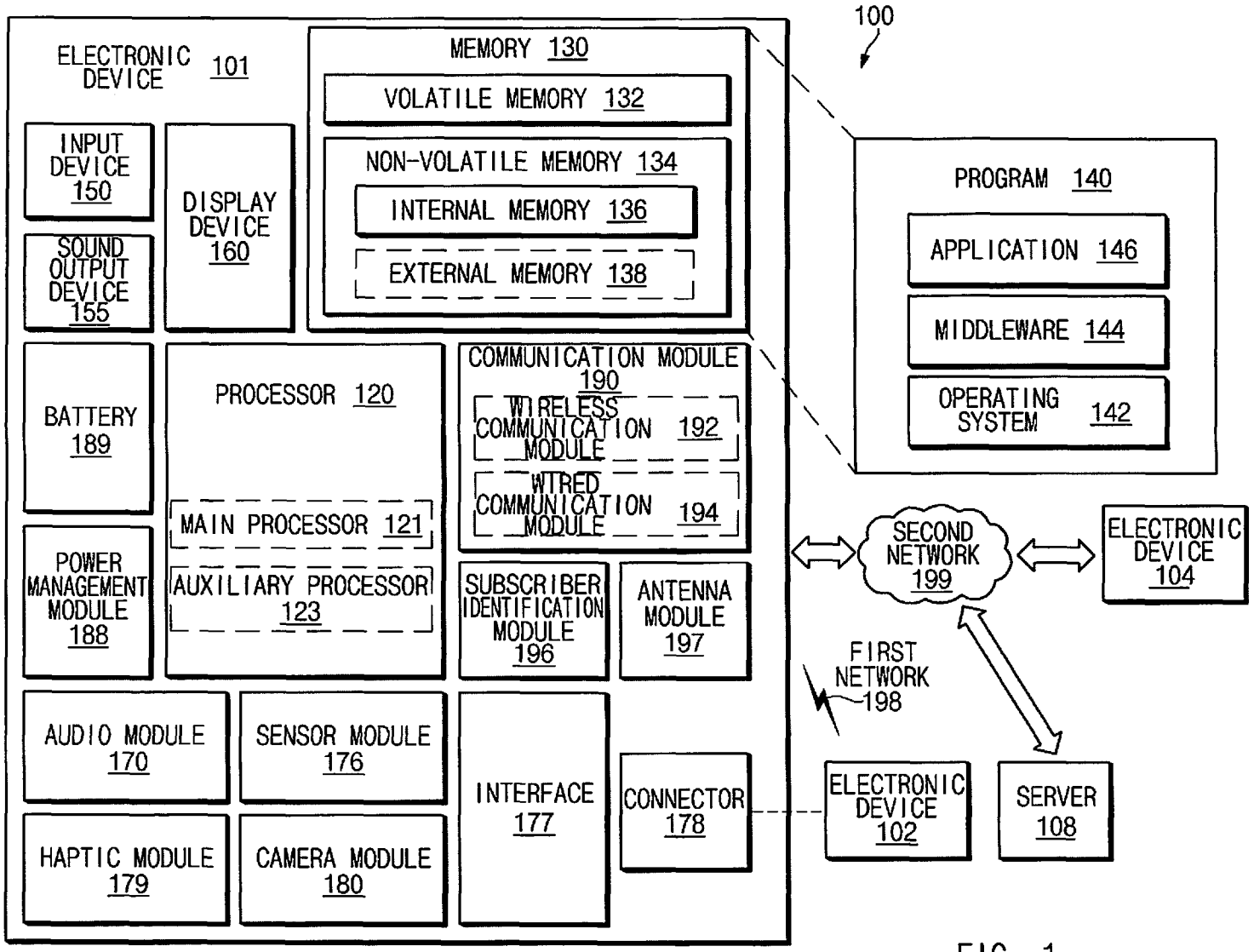
FIG. 1 illustrates an electronic device in a network, according to an embodiment.

FIG. 1 illustrates an electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, ISPs, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more CPs that are operable independently from the processor 120 (e.g., the AP) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., a printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory storage medium" means a tangible device, and does not include a signal (e.g., an electromagnetic wave), but this term does not differentiate between where data is semi-permanently stored in the storage medium and where the data is temporarily stored in the storage medium. For example, "the non-transitory storage medium" may include a buffer where data is temporally stored.

According to an embodiment, a method according to various embodiments of the disclosure may be included and provided in a computer program product. The computer program product may be traded as a product between a seller and a buyer. The computer program product (e.g., downloadable app)) may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
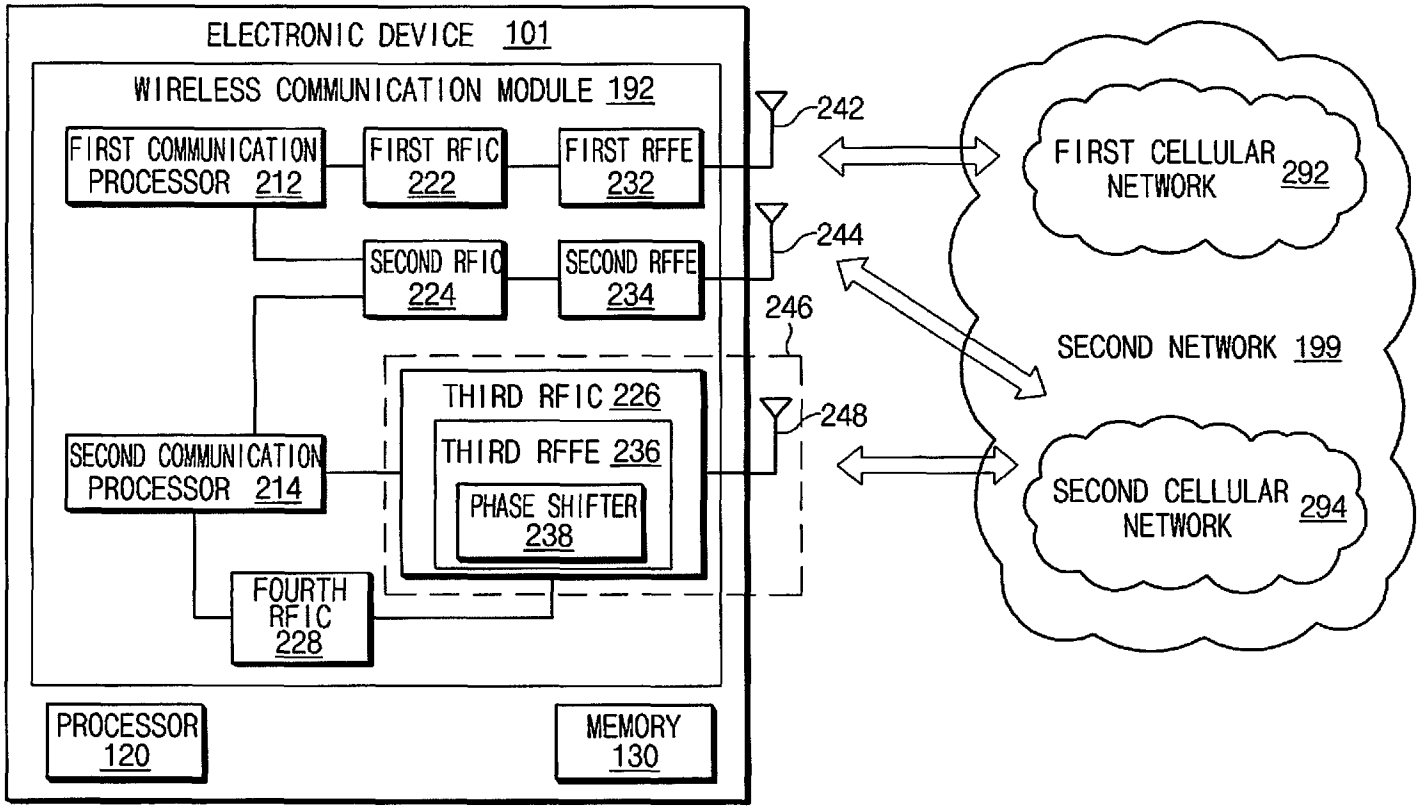
FIG. 2 illustrates an electronic device supporting legacy network communication and fifth generation (5G) network communication, according to an embodiment.

FIG. 2 illustrates an electronic device supporting legacy network communication and 5G network communication, according to an embodiment. Referring to FIG. 2, the electronic device 101 includes a first CP 212, a second CP 214, a first RFIC 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 further includes a processor 120 and a memory 130.

The second network 199 includes a first cellular network 292 and a second cellular network 294.

Alternatively, the electronic device 101 may further include at least one of the components illustrated in FIG. 1, and the second network 199 may include at least one other network.

The first CP 212, the second CP 214, the first RFIC 222, the second RFIC 224, the fourth RFIC 228, the first RFFE 232, and the second RFFE 234 may form at least part of the wireless communication module 192. Alternatively, the fourth RFIC 228 may be omitted or included as the part of the third RFIC 226.

The first CP 212 may support the establishment of a communication channel of a band to be used for wireless communication with the first cellular network 292 and the legacy network communication through the established communication channel. The first cellular network 292 may be a legacy network including second generation (2G), third generation (3G), fourth generation (4G), and/or long term evolution (LTE) network. The second CP 214 may support the establishment of a communication channel corresponding to a specified band (e.g., 6 GHz~60 GHz) among bands to be used for wireless communication with the second cellular network 294 and 5G network communication via the established communication channel. The second cellular network 294 may be 5G network defined in 3 GPP. Additionally, the first CP 212 or the second CP 214 may establish a communication channel for a specified band (e.g., 6 GHz or lower) of the bands to be used for wireless communication with the second cellular network 294 and may support 5G network communication through the established communication channel.

The first CP 212 and the second CP 214 may be implemented within a single chip or a single package. The first CP 212 or the second CP 214 may be implemented within a single chip or a single package with the processor 120, the auxiliary processor 123 of FIG. 1, or the communication module 190.

At the time of transmission, the first RFIC 222 may convert a baseband signal generated by the first CP 212 to a radio frequency (RF) signal of about 700 MHz to about 3 GHz used for the first cellular network 292 (e.g., a legacy network). At the time of reception, the RF signal may be obtained from the first cellular network 292 via the first antenna module 242 and may be preprocessed via the first RFFE 232. The first RFIC 222 may convert the preprocessed RF signal to a baseband signal to be processed by the first CP 212.

To transmit a signal, the second RFIC 224 may convert a baseband signal generated by the first CP 212 or the second CP 214 into an RF signal (hereinafter referred to as a "5G Sub6 RF signal") in a Sub6 band (e.g., 6 GHz or lower) used in the second cellular network 294 (e.g., a 5G network).

At the time of reception, the 5G Sub6 RF signal may be obtained from the second cellular network 294 via the second antenna module 244 and may be preprocessed via the second RFFE 234. The second RFIC 224 may convert the preprocessed 5G Sub6 RF signal to a baseband signal to be processed by a CP corresponding to the first CP 212 and/or the second CP 214.

At the time of transmission, the third RFIC 226 may convert a baseband signal generated by the second CP 214, to an RF signal (hereinafter referred to as a "5G Above6 RF signal") of a 5G Above6 band (e.g., 6 GHz~60 GHz) to be used for the second cellular network 294 (e.g., 5G network).

At the time of reception, the 5G Above6 RF signal may be obtained from the second cellular network 294 via the antenna module 248 and may be preprocessed via the third RFFE 236. For example, the third RFFE 236 may perform preprocessing of a signal, using a phase shifter 238. The third RFIC 226 may convert the preprocessed 5G Above6 RF signal to a baseband signal to be processed by the second CP 214. The third RFFE 236 may be formed as the part of the third RFIC 226.

The electronic device 101 may include the fourth RFIC 228 independent of the third RFIC 226 or as at least part thereof. In this case, the fourth RFIC 228 may convert the baseband signal generated by the second CP 214, to an RF signal of an intermediate frequency band (hereinafter referred to as an intermediate frequency (IF) signal), e.g., 9 GHz-11 GHz, and then may transmit the IF signal to the third RFIC 226. The third RFIC 226 may convert the IF signal to the 5G Above6 RF signal.

At the time of reception, the 5G Above6 RF signal may be received from the second cellular network 294 (e.g., 5G network) via the antenna 248 and may be converted to the IF signal by the third RFIC 226. The fourth RFIC 228 may convert the IF signal to the baseband signal such that the second CP 214 is capable of processing the baseband signal.

The first RFIC 222 and the second RFIC 224 may be implemented as at least part of a single chip or a single package. The first RFFE 232 and the second RFFE 234 may be implemented as at least part of a single chip or a single package. At least one antenna module of the first antenna module 242 or the second antenna module 244 may be omitted or may be coupled to another antenna module and then may process RF signals of a plurality of corresponding bands.

The third RFIC 226 and the antenna 248 may be disposed on the same substrate to form the third antenna module 246. For example, the wireless communication module 192 or the processor 120 may be disposed on a first substrate (e.g., a main PCB). In this case, the third RFIC 226 may be disposed in a partial region (e.g., a bottom surface) of a second substrate (e.g., a sub PCB) separate from the first substrate; the antenna 248 may be disposed in another partial region (e.g., an upper surface), and thus, the third antenna module 246 may be formed. For example, the antenna 248 may include an antenna array for beamforming.

A length of the transmission line between the third RFIC 226 and the antenna 248 may be reduced by positioning the third RFIC 226 and the antenna 248 on the same substrate. Decreasing the transmission line may reduce the loss (or attenuation) of a signal in a high-frequency band (e.g., 6 GHz to 60 GHz) used for the 5G network communication, improving the quality and/or speed of communication with the second cellular network 294.

The second cellular network 294 may be used independently of the first cellular network 292 (e.g., stand-alone (SA)) or may be used in conjunction with the first cellular network 292 (e.g., non-stand-alone (NSA)). For example, only an access network (e.g., a 5G radio access network (RAN) or a next generation (NG) RAN may be present in the 5G network, and a core network (e.g., a next generation core (NGC)) may be absent from the 5G network. In this case, the electronic device 101 may access the access network of the 5G network and may then access an external network (e.g., Internet) under control of the core network (e.g., an evolved packed core (EPC)) of the legacy network. Protocol information (e.g., LTE protocol information) for communication with the legacy network or protocol information (e.g., New Radio NR protocol information) for communication with the 5G network may be stored in the memory 130, and accessed by another component (e.g., the processor 120, the first CP 212, or the second CP 214).

Figure 3:
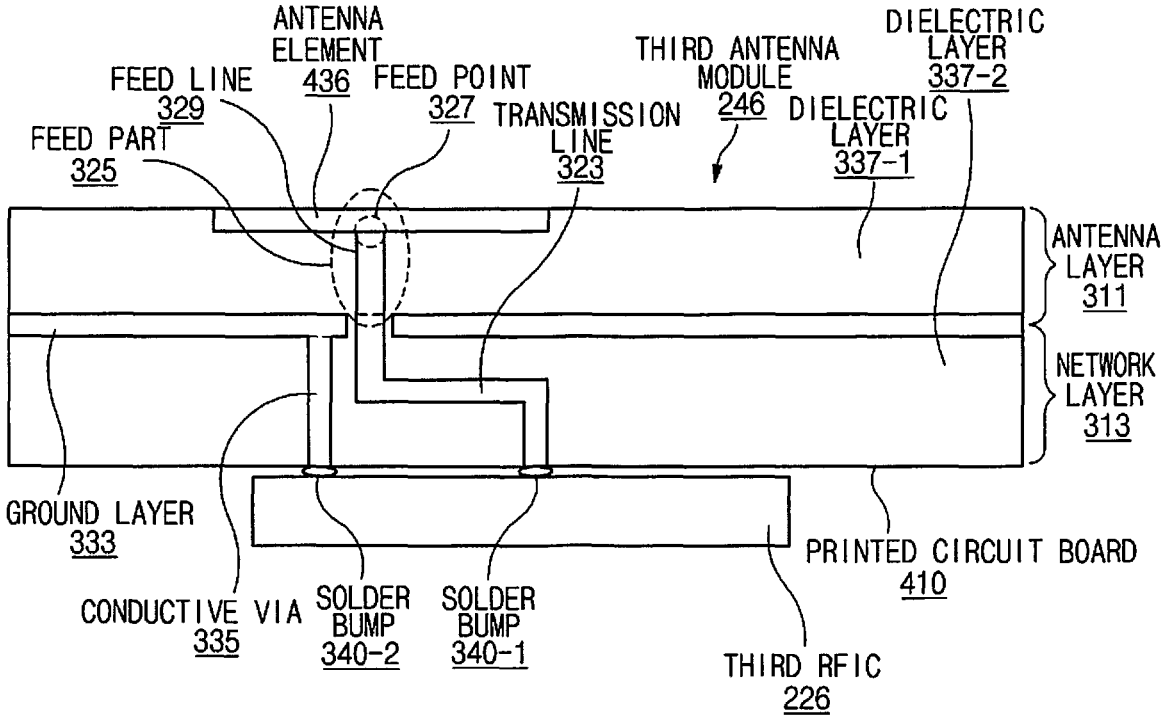
FIG. 3 illustrates a cross-sectional view of a third antenna module taken along a line B-B' of FIG. 4.
Figure 4:
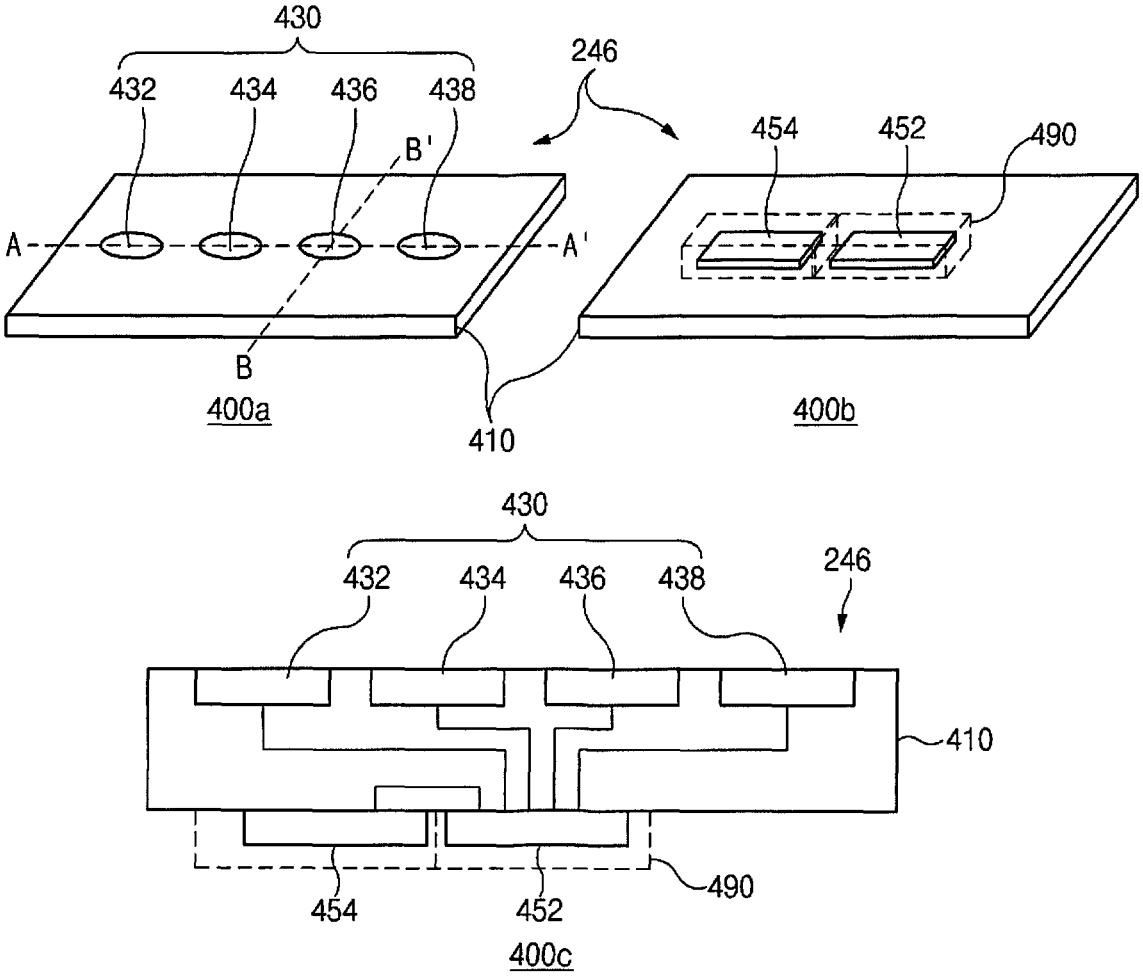
FIG. 4 illustrates a third antenna module of FIG. 2, according to an embodiment.

FIG. 3 illustrates a cross-sectional view of a third antenna module taken along a line B-B' of FIG. 4.

Referring to FIG. 3, a PCB 410 includes an antenna layer 311 and a network layer 313.

The antenna layer 311 includes a dielectric layer 337-1, an antenna element 436, and a feed part 325 formed on an outer surface of the dielectric layer 337-1. The feed part 325 includes a feed point 327 and a feed line 329.

The network layer 313 includes a dielectric layer 337-2, a ground layer 333, a conductive via 335, and a transmission line 323 formed on an outer surface of the dielectric layer 337-2.

In addition, the third RFIC 226 may be electrically connected to the network layer 313, through first and second solder bumps 340-1 and 340-2. Alternatively, various connection structures (e.g., soldering or a ball grid array (BGA)) may be utilized instead of the solder bumps. The third RFIC 226 may be electrically connected with the antenna element 436 through the first connection part 340-1, the transmission line 323, and the feed part 325. The third RFIC 226 may be electrically connected to the ground layer 333 through the second connection part 340-2 and the conductive via 335.

FIG. 4 illustrates a third antenna module of FIG. 2, according to an embodiment. In FIG. 4, 400*a* is a perspective view of the third antenna module 246 when viewed from one side, 400*b* is a perspective view of the third antenna module 246 when viewed from another side, and 400*c* is a cross-sectional view of the third antenna module 246 taken along a line A-A'.

Referring to FIG. 4, the third antenna module 246 includes a PCB 410, an antenna array 430, an RFIC 452, a PMIC 454, and/or a module interface. The third antenna module 246 further includes a shielding member 490. Alternatively, at least one of the above components may be omitted, or at least two of the components may be integrally formed.

The PCB 410 may include a plurality of conductive layers and a plurality of non-conductive layers, and the conductive layers and the non-conductive layers may be alternately stacked. The PCB 410 may provide electrical connection with various electronic components disposed on the PCB 410 or on the outside, using wires and conductive vias formed in the conductive layers.

The antenna array 430 includes a plurality of antenna elements 432, 434, 436, and 438 disposed to form a directional beam. In FIG. 4, the antenna elements are formed on a first surface of the PCB 410. However, the antenna array 430 may be formed within the PCB 410. The antenna array 430 may include a plurality of antenna arrays (e.g., a dipole antenna array and/or a patch antenna array), the shapes or kinds of which are identical or different.

The RFIC 452 may be disposed on another region (e.g., a second surface facing away from the first surface) of the PCB 410 to be spaced apart from the antenna array 430. The RFIC 452 may be configured to process a signal in the selected frequency band, which is transmitted or received through the antenna array 430.

When transmitting a signal, the RFIC 452 may convert a baseband signal obtained from a CP into an RF signal. When receiving a signal, the RFIC 452 may convert an RF signal received through the antenna array 430 into a baseband signal and may provide the baseband signal to the CP.

Alternatively, when transmitting a signal, the RFIC 452 may up-convert an IF signal (e.g., 9 GHz to 11 GHz) obtained from an intermediate frequency integrated circuit (IFIC) into an RF signal. When receiving a signal, the RFIC 452 may down-convert an RF signal obtained through the antenna array 430 into an IF signal and may provide the IF signal to the IFIC.

The PMIC 454 may be disposed on another region (e.g., the second surface) of the PCB 410, which is spaced apart from the antenna array. The PMIC 454 may be supplied with a voltage from a main PCB and may provide power for various components (e.g., the RFIC 452) on an antenna module.

The shielding member 490 may be disposed at a portion (e.g., on the second surface) of the PCB 410 such that at least one of the RFIC 452 or the PMIC 454 is electromagnetically shielded. The shielding member 490 may include a shield can.

Although not illustrated in drawings, the third antenna module 246 may be electrically connected with another PCB (e.g., a main circuit board) through a module interface. The module interface may include a connection member, e.g., a coaxial cable connector, a board to board connector, an interposer, and/or a flexible PCB (FPCB). The RFIC 452 and/or the PMIC 454 of the third antenna module 246 may be electrically connected with the PCB through the connection member.

The third antenna module 246 may be positioned inside the housing of an electronic device. The housing may form at least part of the appearance of the electronic device. The housing may include a first plate (e.g., a part forming a front surface of the electronic device), a second plate (e.g., a part forming a rear surface of the electronic device) facing away from the first plate, and a side member surrounding a space between the first plate and the second plate. For example, the side member may be formed integrally with the second plate. As another example, the side member may be coupled with the second plate. At least part of the side member may be used as a conductive radiator for the transmission and reception in a specified frequency. The electronic device may include a display, which is viewable through at least part of the first plate.

Hereinafter, the third antenna module 246 may be referred to as an "antenna structure".

Figure 5:
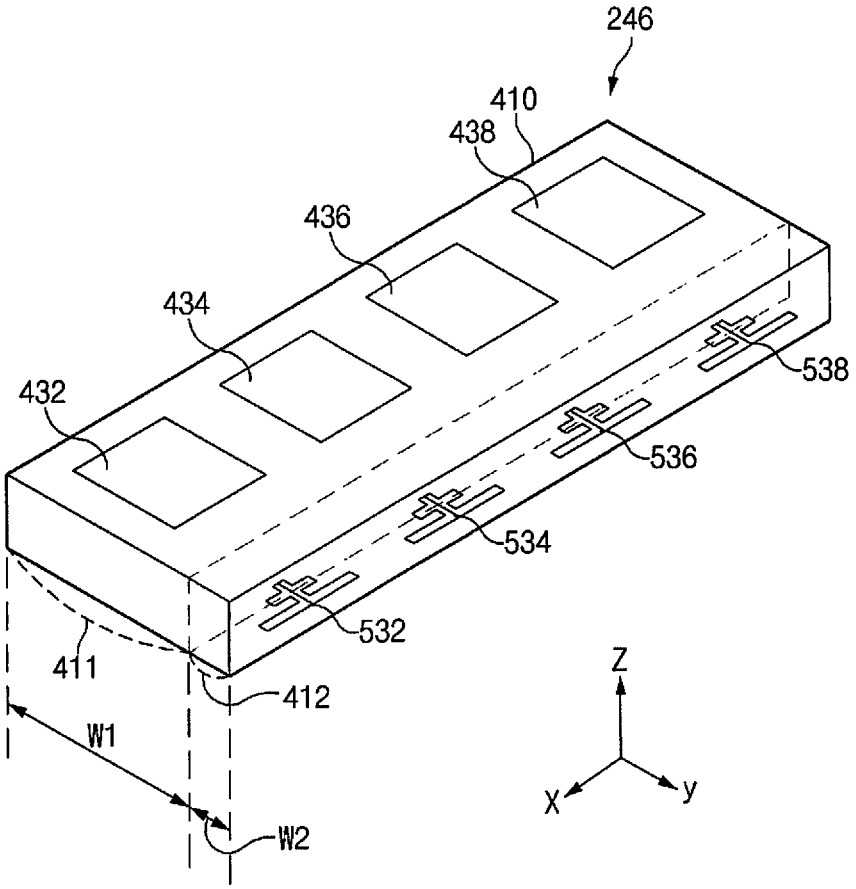
FIG. 5 illustrates an antenna module, according to an embodiment.

FIG. 5 illustrates an antenna module, according to an embodiment.

Referring to FIG. 5, the antenna module 246 includes a first surface (e.g., the front surface) in a first direction (e.g., up direction (e.g., +z direction) of the antenna module 246) and a second surface (e.g., the rear surface) in a direction (e.g., the down direction (e.g., −z direction) of the antenna module 246) opposite to the first direction. A plurality of antenna elements 432, 434, 436, and 438 may be disposed on the first surface or inside the PCB 410 adjacent to the first surface. For example, each of the plurality of antenna elements 432, 434, 436, and 438 may be referred to as patch-type antenna elements or conductive plates. A plurality of dipole antenna elements 532, 534, 536, and 538 may be mounted inside the PCB 410. For example, a plurality of dipole antenna elements 532, 534, 536, and 538 may be mounted on at least one layer of the plurality of layers of the PCB 410 or within at least one layer thereof.

A wireless communication circuit electrically connected to a plurality of antenna elements 432, 434, 436, and 438 and the plurality of dipole antenna elements 532, 534, 536, and 538 may be disposed on the second surface.

The antenna module 246 includes a first region 411 and a second region 412. For example, the first region 411 may indicate a region in which a conductive region is positioned on at least one layer of the PCB 410 or within at least one layer of the PCB 410, when viewed from the first surface or the second surface with respect to the antenna module 246. For example, the first region 411 may extend by a length W1 on the y-axis. The second region 412 may indicate a region in which the PCB 410 is formed of a non-conductive material other than the plurality of dipole antenna elements 532, 534, 536, and 538, when viewed from the first surface or the second surface with respect to the antenna module 246. The ground layer of the PCB 410 may not be present in the second region 412 (e.g., a fill-cut region). For example, the second region 412 may extend by a length W2 on the y-axis.

The plurality of dipole antenna elements 532, 534, 536, and 538 may be mounted in the second region 412 while protruding from the first region 411. To transmit and/or receive a wireless signal of a specified frequency, the plurality of dipole antenna elements 532, 534, 536, and 538 may be positioned in the second region 412 where the ground layer is not present.

For example, the antenna module 246 may be mounted in the housing of the electronic device to be substantially perpendicular to the first plate and/or the second plate of the housing of the electronic device. In this case, the thickness of the electronic device may be determined depending on the length 'W1+W2' of the minor axis of the first surface of the antenna module 246. The length ' W1+W2' of the minor axis of the first surface of the antenna module 246 including the plurality of dipole antenna elements 532, 534, 536, and 538 may be reduced using a stub.

Figure 6:
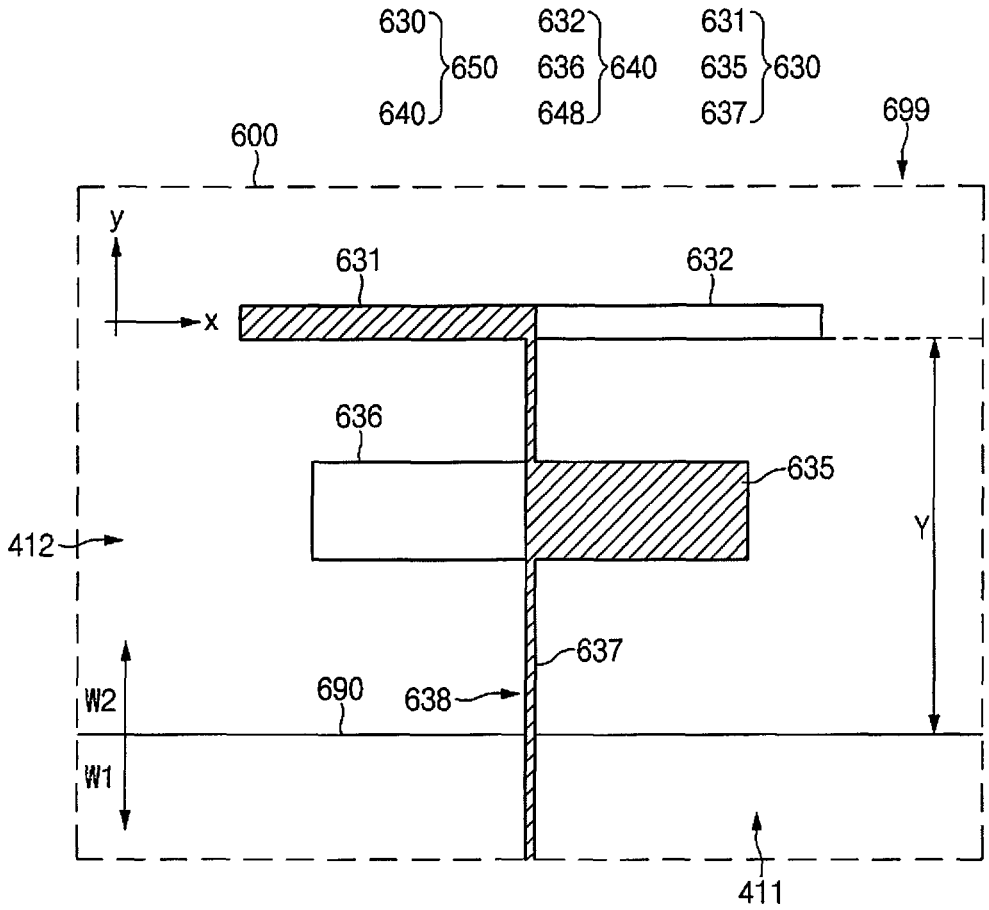
FIG. 6 illustrates a dipole antenna, according to an embodiment.
Figure 6:
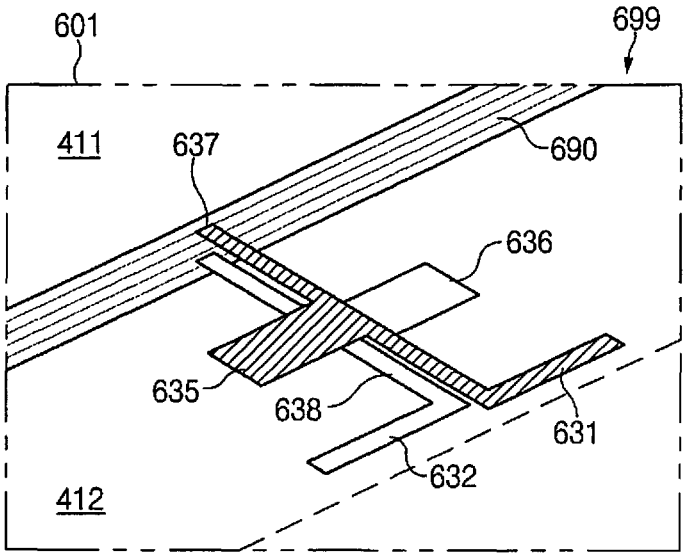

FIG. 6 illustrates a dipole antenna of an antenna module, according to an embodiment.

Referring to FIG. 6, an antenna structure 699 includes a first region 411, a second region 412, and a dipole antenna 650.

Referring to reference numeral 600, when viewed from above the first surface (e.g., a front surface) of the antenna structure 699, the first region 411 includes a periphery 690 extending in a direction perpendicular to the direction in which the first surface faces. The second region 412 may be in contact with the periphery 690 of the first region 411.

The dipole antenna 650 includes a first conductive pattern 630 and a second conductive pattern 640. The first conductive pattern 630 includes a first radiation part 631 (e.g., a conductive strip), a first conductive line 637, and a first stub 635. For example, the first radiation part 631 may extend in parallel with the periphery 690 within the second region 412 and one end of the first radiation part 631 may be connected to the first conductive line 637. The first conductive line 637 may extend from the second region 412 to the first region 411 and may extend in a direction substantially perpendicular to the first radiation part 631. The first stub 635 may extend from the first conductive line 637 between the first radiation part 631 and the periphery 690 and may extend in the opposite direction (e.g., +x direction) to first radiation part 631.

The second conductive pattern 640 includes a second radiation part 632, a second conductive line 638, and a second stub 636. The second radiation part 632 may extend in parallel with the periphery 690 within the second region 412 and one end of the second radiation part 632 may be connected to the second conductive line 638. The second conductive line 638 may extend from the second region 412 to the first region 411 and may extend in a direction (e.g., −y direction) substantially perpendicular to the second radiation part 632. The second stub 636 may extend from the second conductive line 638 between the second radiation part 632 and the periphery 690 and may extend in the opposite direction (e.g., −x direction) to second radiation part 632.

The first radiation part 631 and the second radiation part 632 may be spaced from the periphery 690 of the first region 411 by a specified distance. For example, the first radiation part 631 and the second radiation part 632 may be spaced from the periphery 690 by a distance 'Y'. The first radiation part 631 and the second radiation part 632 may extend in opposite directions from each other. The first radiation part 631 and the second radiation part 632 may be formed to transmit or receive a signal in a specified first frequency band.

Referring to reference numeral 601, the first conductive pattern 630 and the second conductive pattern 640 may be implemented on different layers or in different layers. In reference numeral 601, the first conductive pattern 630 is implemented above the second conductive pattern 640. However, the disclosure is not limited to configuration. For example, the first conductive pattern 630 may be mounted in a lower layer than the second conductive pattern 640.

Referring to reference numerals 600 and 601, the first conductive line 637 may be electrically connected to the first radiation part 631, and the second conductive line 638 may be electrically connected to the second radiation part 632. For example, the first conductive line 637 and the second conductive line 638 may transmit signals of different polarities to the first radiation part 631 and the second radiation part 632, respectively. As another example, the first conductive line 637 may apply a signal to the first radiation part 631, and the second conductive line 637 may connect the second radiation part 632 to ground.

In FIG. 6, the length 'Y' in the second region 412 of the first conductive line 637 and the second conductive line 638 for impedance matching of the dipole antenna 650 may be reduced using the first stub 635 and the second stub 636. For example, the first stub 635 and the second stub 636 may be open stubs. The first stub 635 and the second stub 636 may reduce the length 'Y' of the first conductive line 637 and the second conductive line 638 by providing an additional current path to the first conductive line 637 and the second conductive line 638.

Figure 7:
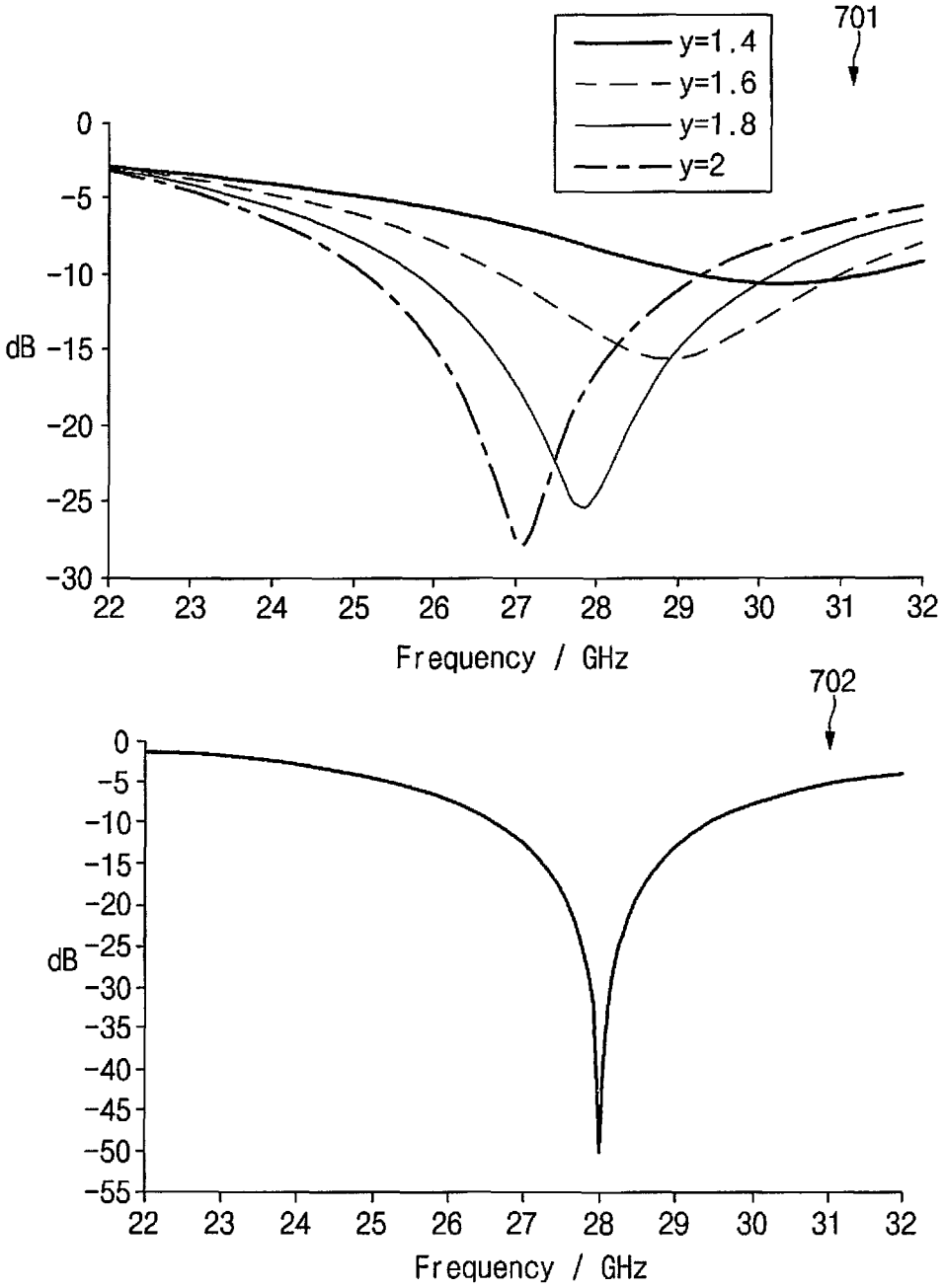
FIG. 7 illustrates graphs of reflection coefficients according to a length of a feed line.

FIG. 7 illustrates graphs of reflection coefficients according to a length of a feed line. Specifically, FIG. 7 illustrates reflection coefficients according to a length 'Y' of the antenna module 246, wherein it is assumed that the second region 412 has the permittivity of 3.5.

Referring to FIG. 7, in graph 701, when the dipole antenna element of the antenna module 246 does not include a stub, the length 'y' needs to be about 1.8 mm to ensure matching characteristics at 28 GHz.

Graph 702 illustrates the reflection coefficient of the antenna structure 699 of FIG. 6 in which a dipole antenna element includes a stub. In graph 702, the length 'y' is 1.1 mm. Accordingly, when the stub is used, the length of the second region 412 may be reduced by about 40%. Further, the length (e.g., the lengths W1 and W2 of FIG. 5) of the minor axis of the antenna module may be reduced.

Figure 8:
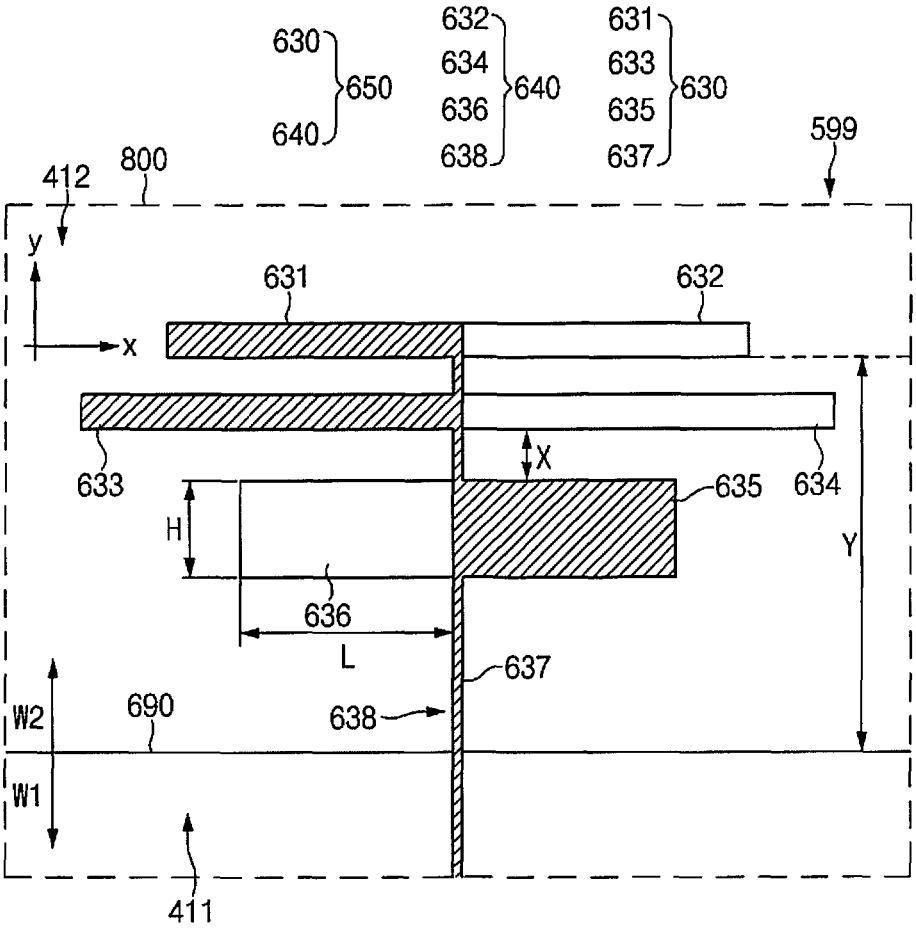
FIG. 8 illustrates a dipole antenna, according to an embodiment.
Figure 8:
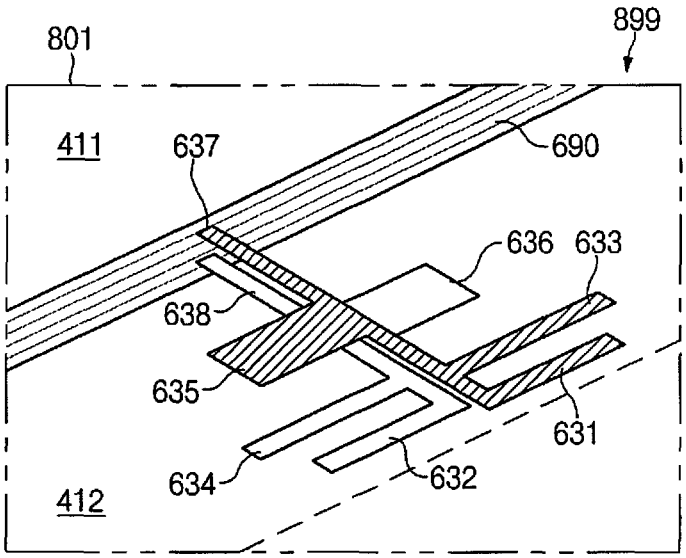

FIG. 8 illustrates a dipole antenna, according to an embodiment.

Referring to FIG. 8, an antenna structure 899 includes the first region 411, the second region 412, and the dipole antenna 650. The dipole antenna 650 may be configured to transmit and/or receive signals in a plurality of frequency bands. The dipole antenna 650 includes the first conductive pattern 630 and the second conductive pattern 640. The description about the configuration having the same identification number as that of FIG. 6 may be referenced by the description of FIG. 6.

The dipole antenna 650 includes a third radiation part 633 (e.g., conductive strip) and a fourth radiation part 634 (e.g., conductive strip), which are configured to transmit a signal in a specified second frequency band. The third radiation part 633 may extend from the first conductive line 637 in a direction (e.g., −x direction) that is substantially parallel to the periphery 690 of the first region 411. The fourth radiation part 634 may extend from the second conductive line 638 in a direction (e.g., +x direction) that is substantially parallel to the periphery 690 of the first region 411. The third radiation part 633 and the fourth radiation part 634 may be positioned within the second region 412. When viewed from above the first surface of the antenna structure 899, the third radiation part 633 and the fourth radiation part 634 may be positioned between the first stub 635 and the second stub 636 and the first radiation part 631 and the second radiation part 632 for the first frequency band. For example, the fourth radiation part 634 may be spaced from the first stub 635 by a distance 'X'. The third radiation part 633 may be spaced from the second stub 636 by the distance 'X'.

Each of the first stub 635 and the second stub 636 may be a conductive pattern having the length 'L' and the height 'H'. The first stub 635 and the second stub 636 may be used to tune the dipole antenna 650. For example, the characteristics of the dipole antenna 650 may be tuned by adjusting the length 'L', the height 'H', and/or the distance 'X' of the conductive pattern.

Referring to reference numeral 800, although the second conductive line 638 is not illustrated to be overlapped by the first conductive line 637, as illustrated in reference numeral 801, the second conductive line 638 may be positioned on the lower layer of the first conductive line 637 as described above with respect to FIG. 6.

Figure 9:
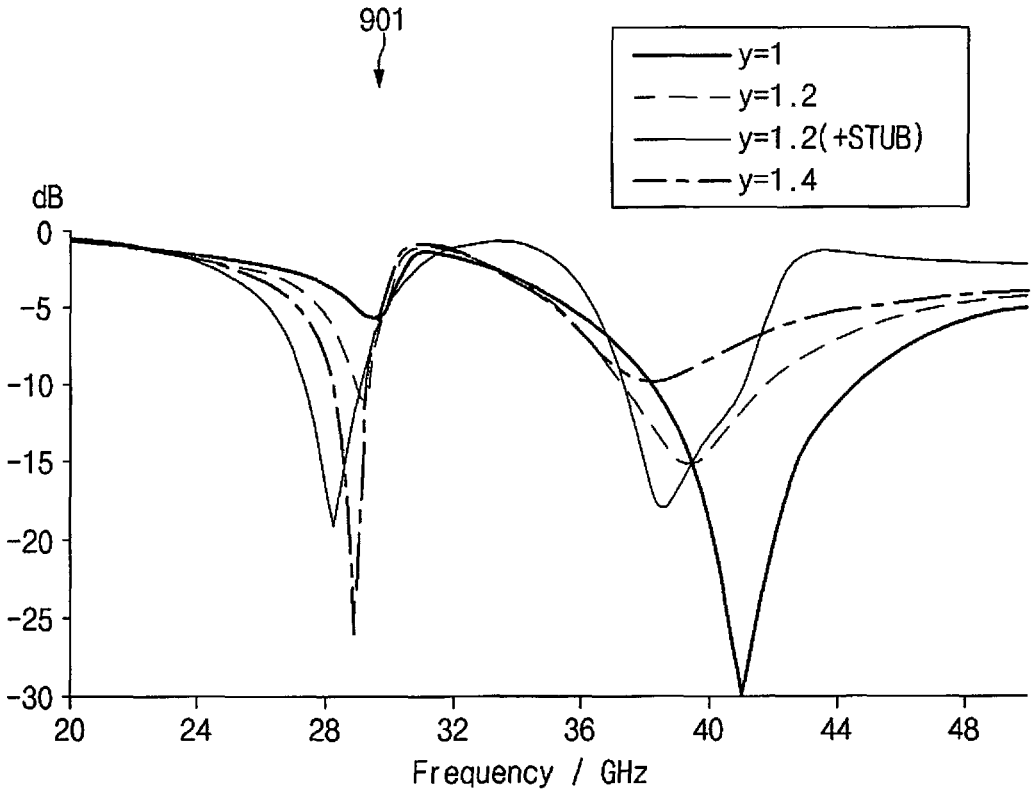
FIG. 9 illustrates a graph of reflection coefficients according to a length of a feed line.

FIG. 9 is a graph illustrating reflection coefficients according to a length of a feed line.

Referring to FIG. 9, for a dual-band dipole antenna (e.g., the dipole antenna 650 of FIG. 8), even though the length 'y' of at least one conductive line is increased to 1.4 mm without a stub (e.g., the first stub 635 or the second stub 636 of FIG. 8), good characteristics are not seen in both goal frequency bands (e.g., 28 GHz and 39 GHz). However, when the stub is used, good characteristics may be observed in both goal frequency bands, where the length of 'y' is 1.2 mm. Accordingly, the stub may reduce the length 'y' of the dipole antenna 650 and also affect impedance matching.

Figure 10:
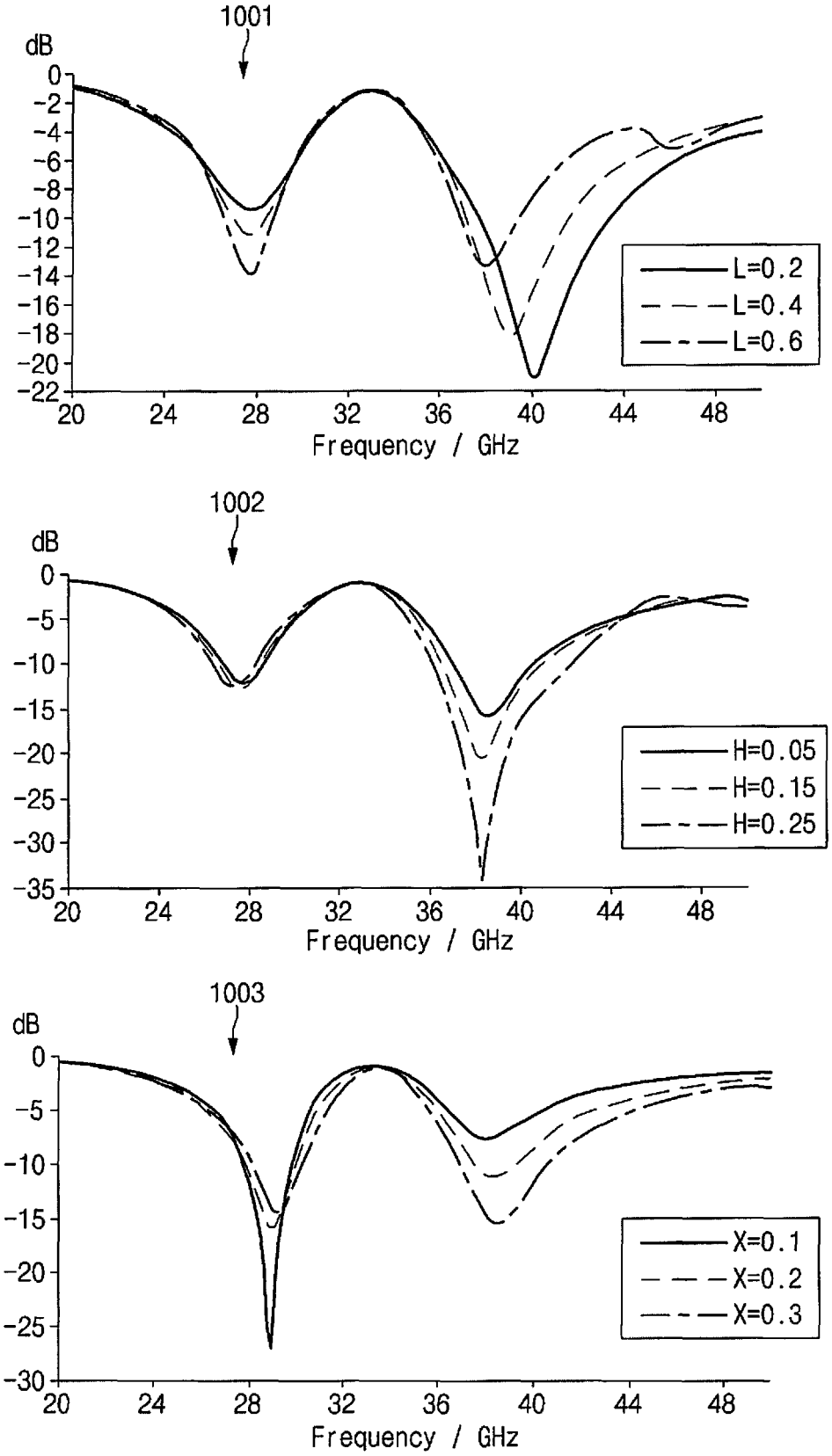
FIG. 10 illustrates graphs of reflection coefficients, according to a configuration of a stub.

FIG. 10 illustrates graphs of reflection coefficients, according to a configuration of a stub.

Referring to FIG. 10, in graph 1001, the dipole antenna (e.g., the dipole antenna 650 of FIG. 8) may be tuned by adjusting the length 12 of the stub (e.g., the first stub 635 or the second stub 636). For example, good characteristics in both goal frequency bands appear when the length 'L' of the stub is 0.4 mm.

Referring to graph 1002, the dipole antenna 650 may be tuned by adjusting the height 'H' of the stub. For example, good characteristics appear in both goal frequency bands when the height H of the stub is 0.25 mm.

Referring to graph 1003, the dipole antenna 650 may be tuned by adjusting the distance 'X' between the stub and the radiation part. For example, good characteristics appear in both goal frequency bands when the distance 'X' is 0.3 mm.

As illustrated in the graphs of FIG. 10, the dipole antenna 650 may be tuned variously using a stub. The stub may adjust the resonant frequency of the dipole antenna 650 by providing additional design variables in the design of the dipole antenna 650. As another example, using a stub, the dipole antenna 650 may simultaneously adjust the impedance matching characteristics for a plurality of frequency bands.

Figure 11:
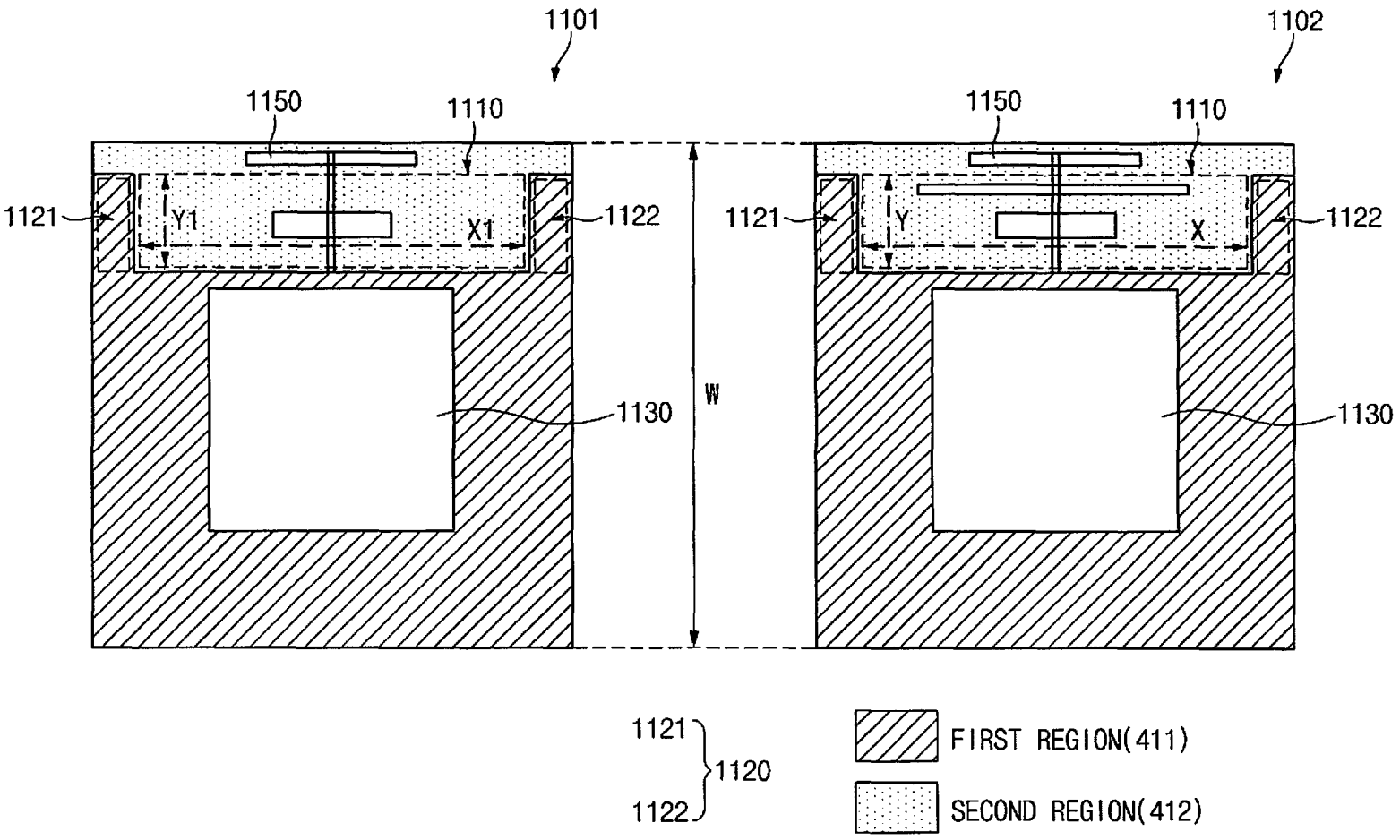
FIG. 11 illustrates an antenna module having a recess, according to an embodiment.

FIG. 11 illustrates an antenna module having a recess, according to an embodiments. Specifically, FIG. 11 illustrates a single element of the antenna module 246 having a recess.

Referring to FIG. 11, in cross-sectional views 1101 and 1102, a recess 1110 may be formed in the first region 411 (e.g., a ground region). The first region 411 includes a first protrusion part 1121, which is positioned at one end of the periphery (e.g., the periphery of a length 'X1') between the first region 411 and the second region 412 (e.g., fill-cut region) and which protrudes in the direction of the second region 412 perpendicular to the periphery, and a second protrusion part 1122, which is positioned at another end of the periphery and which protrudes in the direction of a fill-cut region perpendicular to the periphery. The first protrusion part 1121 and the second protrusion part 1122 may form the recess 1110 in the ground region together with the periphery (e.g., the periphery of the length 'X1'). Hereinafter, each of the first protrusion part 1121 and the second protrusion part 1122 may be referred to as the protrusion part 1120. The length 'X1' of the recess 1110 may be greater than a length by which a dipole antenna 1150 extends in parallel with the periphery of the first region 411.

The recess 1110 may indicate an extension of the second region 412 into the first region 411 or a reduction of the first region 411. For example, the first region 411 may provide ground for the conductive plate 1130. Because the characteristics of the antenna module 246 change due to the reduction of the first region 411, the characteristics of the antenna module may be adjusted by adjusting the length 'X1' and the height 'Y1' of the recess 1110.

Table 1 shows performance changes of the antenna module 246 depending on whether the region of the recess 1110 is present.

TABLE 1

| | | Antenna | | | | | |
|---|---|---|---|---|---|---|---|
| | | Dipole antenna | | Patch horizontal polarization | | Patch vertical polarization | |
| Whether recess is present | | X | ○ | X | ○ | X | ○ |
| Peak Gain (dBi) | 28 GHz | 8.9 | 8.6 | 9.4 | 9 | 9.3 | 9.6 |
| | 39 GHz | 9.4 | 9.3 | 11.4 | 11.2 | 11.5 | 11.4 |

In Table 1, it is assumed that the length X1 of the recess 1110 is 4 mm and the height Y1 is 0.5 mm. The patch may indicate a conductive plate 1130. Even though the recess 1110 is formed because the difference in peak gain due to whether the recess 1110 is present is negligible, the performance of the antenna module 246 may be maintained.

Referring again to FIG. 11, reference numeral 1101 shows the configuration of a single element of the antenna module 246 to which the recess 1110 is applied, e.g., according to the embodiment of FIG. 6. Reference numeral 1102 shows the configuration of a single element of the antenna module 246 to which the recess 1110 is applied, e.g., according to the embodiment of FIG. 8.

As illustrated in reference numerals 1101 and 1102, due to the recess 1110, the dipole antenna 1150 may be moved to a location closer to the conductive plate 1130. As another example, due to the movement of the dipole antenna 1150, the length 'W' of the minor axis of the antenna module 246 may be reduced.

Figure 12:
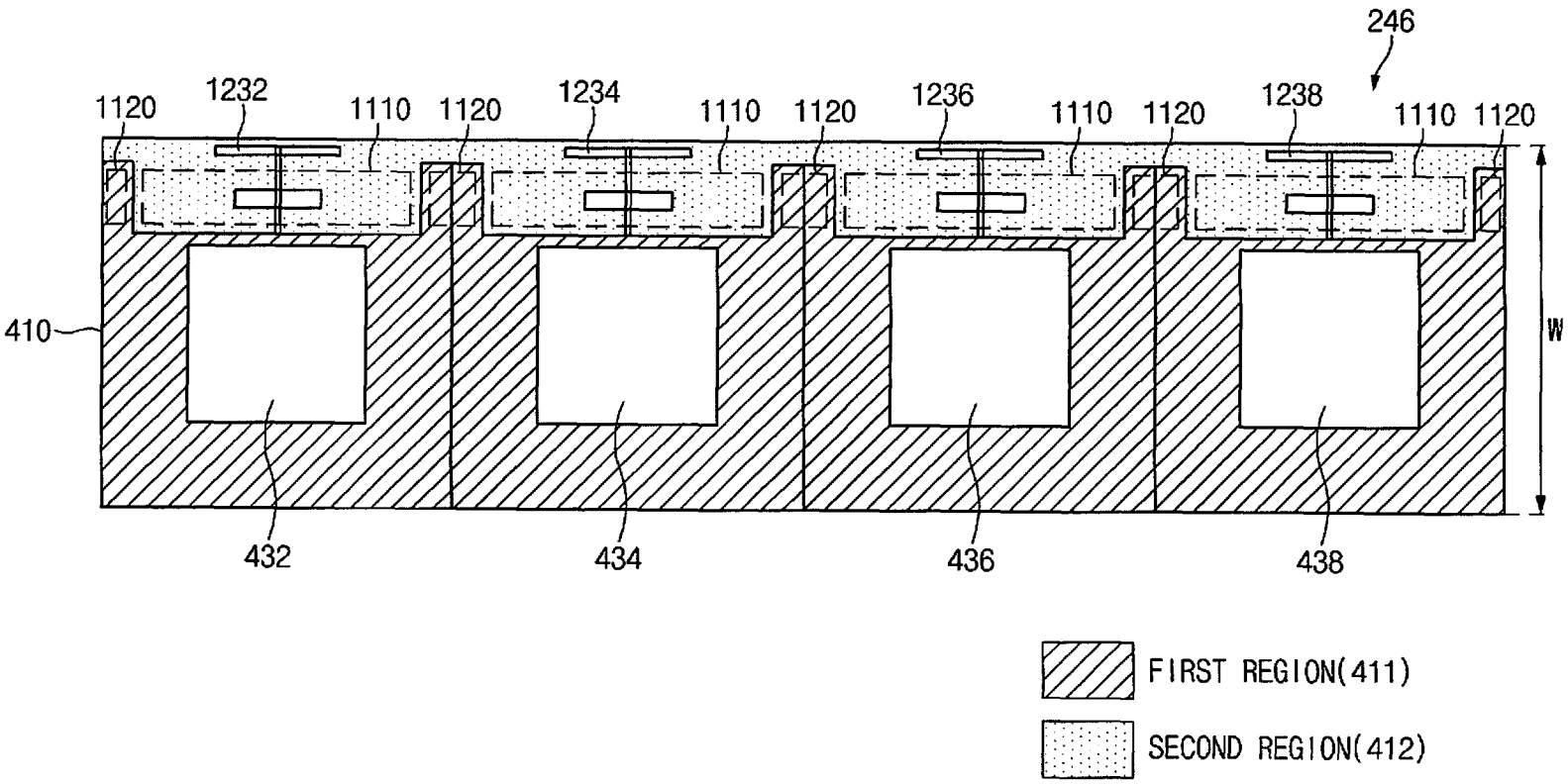
FIG. 12 illustrates an antenna module, according to an embodiment.

FIG. 12 illustrates an antenna module, according to an embodiment.

Referring to FIG. 12, the antenna module 246 includes the first region 411 (e.g., a ground region) having the recess 1110 and the protrusion part 1120. Each of dipole antennas 1232, 1234, 1236, and 1238 may correspond to the dipole antenna 650 of FIG. 6.

As another example, because each of the dipole antennas 1232, 1234, 1236, and 1238 includes a stub, the length of the second region 412 (e.g., a fill-cut region) due to the dipole antenna may be reduced. Accordingly, the length 'W' of the minor axis of the antenna module 246 may be reduced using a stub and a recess. For example, each of the plurality of dipole antennas 532, 534, 536, and 538 may correspond to the dipole antenna 650 of FIG. 6.

Figure 13:
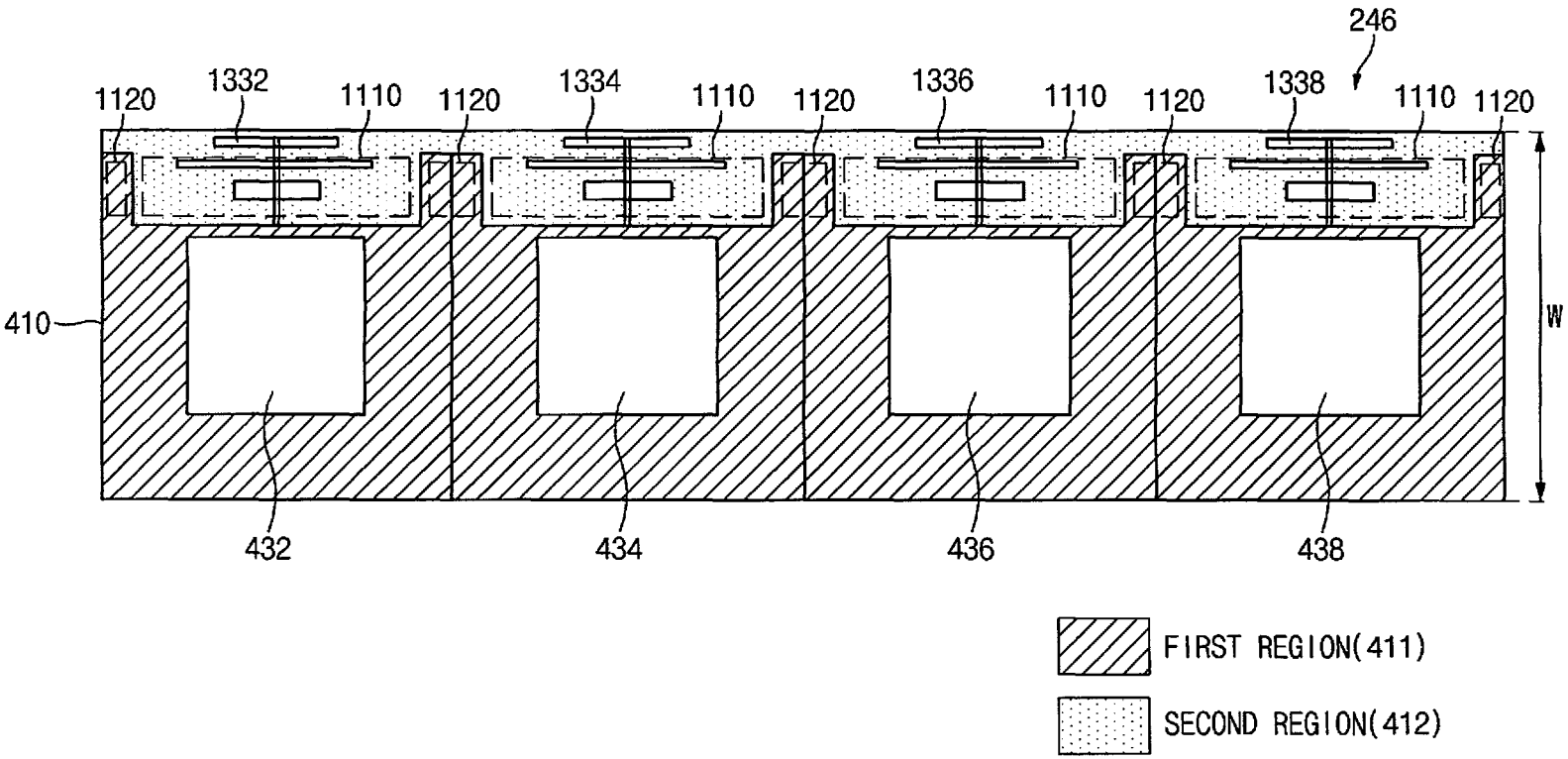
FIG. 13 illustrates an antenna module, according to an embodiment.

FIG. 13 illustrates an antenna module, according to an embodiment.

Referring to FIG. 13, the antenna module 246 includes the first region 411 having the recess 1110 and/or the protrusion part 1120. Each of dipole antennas 1332, 1334, 1336, and 1338 may correspond to the dipole antenna 650 of FIG. 7. As another example, because the dipole antennas 1332, 1334, 1336, and 1338 include a stub, the length of the second region 412 (e.g., a fill-cut region) due to the dipole antenna may be reduced. Accordingly, the length 'W' of the minor axis of the antenna module 246 may be reduced using a stub and the recess 1110. Each of the plurality of antenna elements 432, 434, 436, and 438 may correspond to the antenna elements of FIG. 4.

Figure 14:
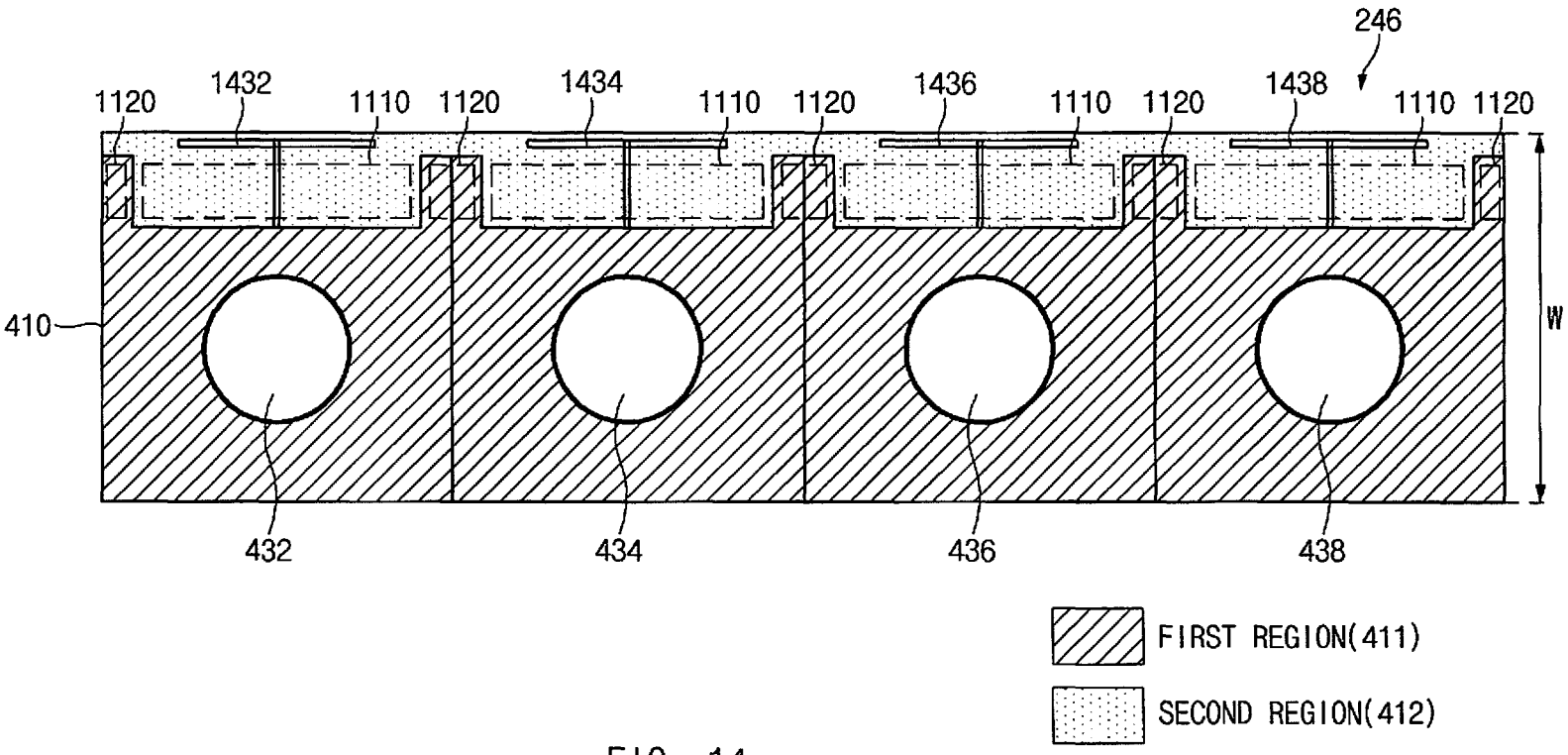
FIG. 14 illustrates an antenna module, according to an embodiment.

FIG. 14 illustrates an antenna module, according to an embodiment.

Referring to FIG. 14, each of dipole antennas 1432, 1434, 1436, and 1438 of the antenna module 246 does not include a stub. The antenna module 246 having the reduced length 'W' of the minor axis may be implemented using the recess 1110 and/or the protrusion parts 1120 formed in the first region 411 (e.g., a ground region). As another example, as the shapes of the antenna elements 432, 434, 436, and 438 are not limited to squares, e.g., as illustrated in FIG. 13, in FIG. 14, the antenna elements 432, 434, 436, and 438 are circular patch antenna elements.

Although an antenna module 246 is illustrated as including four unit devices coupled with each other, the number of unit devices is not limited to four. For example, the antenna module 246 may include three or less unit devices or five or more unit devices coupled with each other.

In the examples of FIGS. 6 and 8 described above, the first antenna pattern 630 and the second antenna pattern 640 are mounted on different layers or in different layers. However, the disclosure are not limited to these configurations. For example, the first antenna pattern 630 and the second antenna pattern 640 may be mounted on the same layer or in the same layer.

Figure 15:
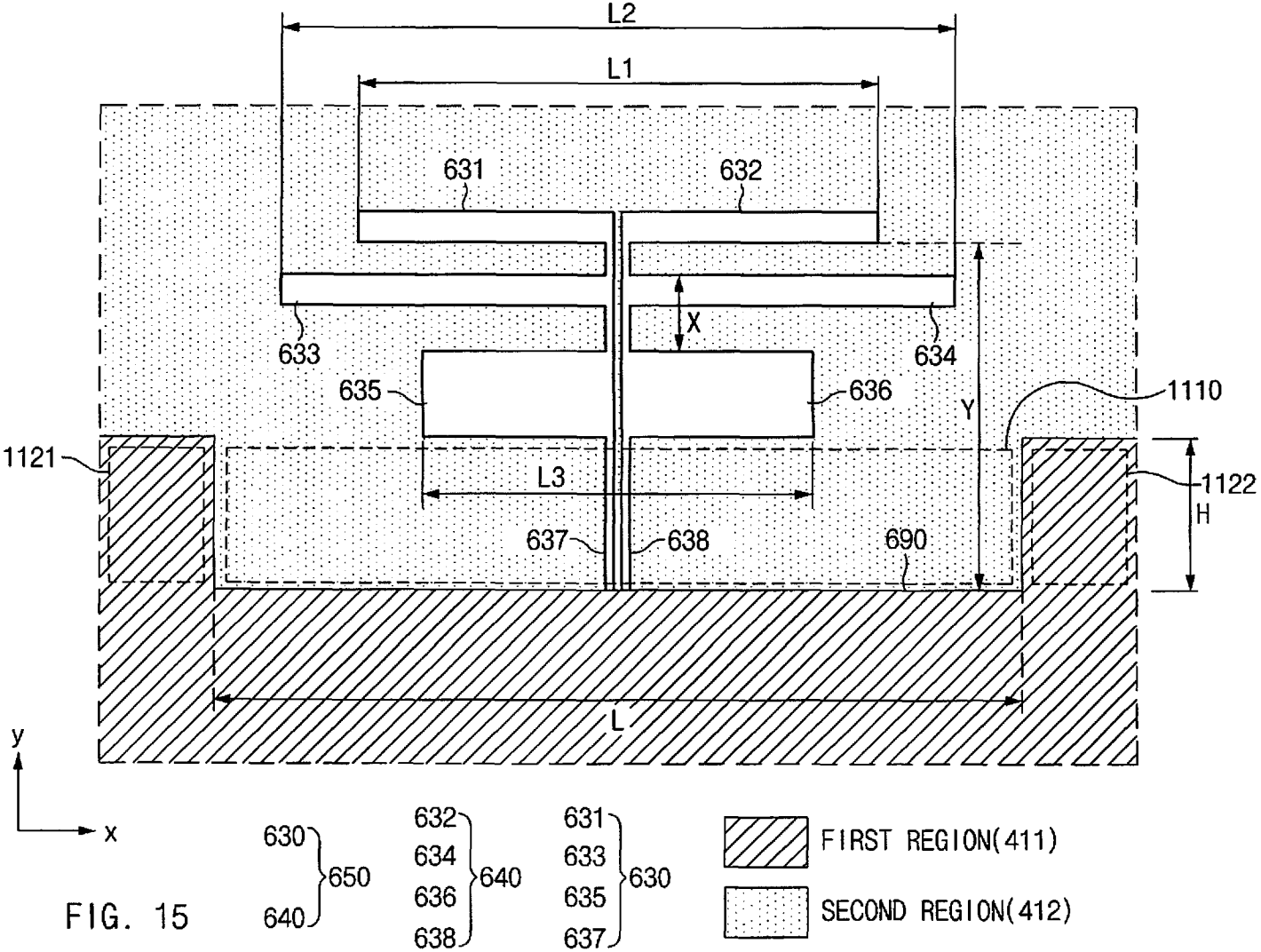
FIG. 15 illustrates a dipole antenna, according to an embodiment.

FIG. 15 illustrates an antenna structure, according to an embodiment.

Referring to FIG. 15, the first antenna pattern 630 and the second antenna pattern 640 are mounted on the same layer or in the same layer. The first radiation part 631, the third radiation part 633, and the first stub 635 that are connected to the first conductive line 637 may extend in the same direction (e.g., −x direction). The second radiation part 632, the fourth radiation part 634, and the second stub 636 that are connected to the second conductive line 638 may extend in the same direction (+x direction). The first radiation part 631, the third radiation part 633, and the first stub 635 may extend in a direction away from the second conductive line 638 (e.g., −x direction). The second radiation part 632, the fourth radiation part 634, and the second stub 636 may extend in a direction away from the first conductive line 637 (e.g., +x direction).

The antenna structure includes the first region 411 (e.g., a ground region) and the second region 412 (e.g., a fill-cut region). The first region 411 includes a periphery (e.g., the periphery of length 'L') extending in the first direction (e.g., x-axis direction). When viewed from above, the first region 411 may include at least one ground layer. The second region 412 may be in contact with the periphery of the first region 411.

The dipole antenna 650 may be mounted in the second region 412 and may include at least one dipole antenna (e.g., the first conductive pattern 630 and/or the second conductive pattern 640). The first dipole antenna (e.g., the first radiation part 631 and the second radiation part 632) may extend in the first direction (e.g., x-axis direction) within the second region 412 and may be spaced from the periphery 690 of the first region 411. The second dipole antenna (e.g., the third radiation part 633 and the fourth radiation part 634) may be positioned between the periphery 690 and the first dipole antenna and may extend in the first direction. A stub (e.g., the first stub 635 and the second stub 636) may be at least one conductive pattern interposed between the periphery 690 and the second dipole antenna.

When viewed from above, the ground layer of the first region 411 may include the first protrusion part 1121 protruding in the second direction (e.g., +y direction) perpendicular to the first direction from one end of the periphery 690 and the second protrusion part 1122 protruding in the second direction from the other end of the periphery. The first protrusion part 1121, the second protrusion part 1122, and the periphery 690 of the first region 411 may form the recess 1110 of the first region 411. For example, the recess 1110 may be referred to as the second region 412 having the height 'H' and the length 'L'. The length 'L' of the recess 1110 may be longer than the length 'L1' of the first dipole antenna and/or the length 'L2' of the second dipole antenna, in x-direction.

When viewed from above the antenna module 246, the first dipole antenna may be electrically connected to the first conductive line 637 and/or the second conductive line 638 extending in the second direction (e.g., −y direction) from the first region 411 to the second region 412.

When view from above the first surface of the antenna module 246, the first dipole antenna may include the first conductive strip (e.g., the first radiation part 631) extending in −x direction from the first conductive line 637 and the second conductive strip (e.g., the second radiation part 632) extending in +x direction from the second conductive line 638.

When view from above the first surface of the antenna module 246, the second dipole antenna may include the third conductive strip (e.g., the third radiation part 633) extending in −x direction from the first conductive line 637 and the fourth conductive strip (e.g., the fourth radiation part 634) extending in +x direction from the second conductive line 638. The first conductive strip and the second conductive strip may have a first length (e.g., the length on the X axis) (e.g., length 'L1'). As another example, the third conductive strip and the fourth conductive strip may have a second length (e.g., the length on the X axis) (e.g., length 'L2'). The first length and the second length may be lengths different from each other.

The first length may correspond to the specified first frequency band (e.g., the frequency band including 39 GHz), and the second length may correspond to the specified second frequency band (e.g., the frequency band including 28 GHz). The second length may be longer than the first length.

The stub may include the first stub 635 extending in −x direction from the first conductive line 637 and the second stub 636 in +x direction from the second conductive line 638. The first stub 635 may be aligned with the second stub 636. Although FIG. 15 illustrates the first stub 635 extending in +x direction from the first conductive line 637 and the second stub 636 extending in −x direction from the second conductive line 638, the disclosure is not limited thereto. For example, as described with reference to FIGS. 6 and 8, the first stub 635 may extend in −x direction from the first conductive line 637, and the second stub 636 may extend in +x direction from the second conductive line 638.

The first conductive pattern 630 and the second conductive pattern 640 may be mounted on the same layer or on different layers. For example, as described with reference to FIGS. 6 and 8, the first conductive pattern 630 and the second conductive pattern 640 may be mounted on different layers. As another example, as described with reference to FIG. 15, the first conductive pattern 630 and the second conductive pattern 640 may be mounted on the same layer.

Figure 16A:
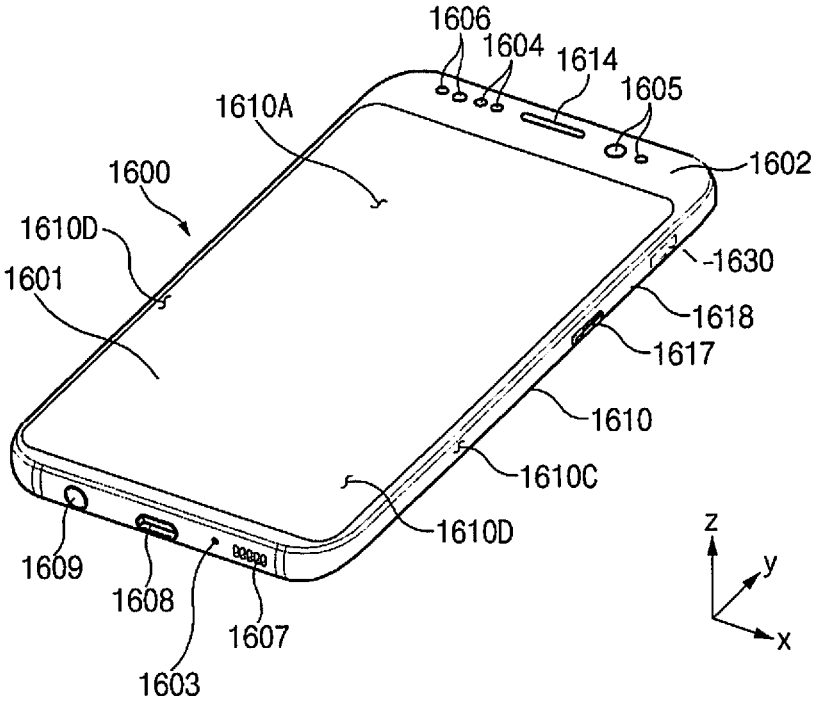
FIG. 16A illustrates a mobile electronic device, according to an embodiment.
Figure 16B:
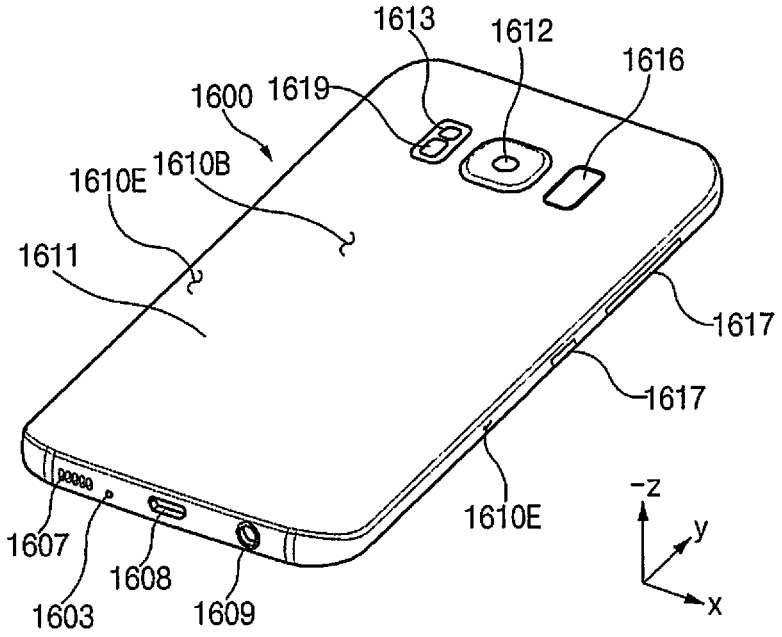
FIG. 16B illustrates a rear surface of an electronic device, according to an embodiment.

FIG. 16A illustrates a front surface of an electronic device, according to an embodiment. FIG. 16B illustrates a rear surface of an electronic device, according to an embodiment.

Referring to FIGS. 16A and 16B, a mobile electronic device 1600 includes a housing 1610, which includes a first surface (or a front surface) 1610A, a second surface (or a rear surface) 1610B, and a side surface 1610C surrounding a space between the first surface 1610A and the second surface 1610B. The housing may be referred to as a "structure" that forms a part of the first surface 1610A, the second surface 1610B, and side surfaces 1610C. The first surface 1610A may be formed by a first plate (or a front plate) 1602 (e.g., a glass plate including various coating layers, or a polymer plate), at least a portion of which is substantially transparent. The second surface 1610B may be implemented with a rear plate 1611 that is substantially opaque. For example, the rear plate 1611 may be implemented with a coated or colored glass, a ceramic, a polymer, a metal (e.g., aluminum, stainless steel (STS), or magnesium), or a combination of at least two of the materials. The side surface 1610C may be coupled with the front plate 1602 and the rear plate 1611, and may be formed by a side bezel structure (or a "side member") 1618 including metal and/or polymer. In any embodiment, the rear plate 1611 and the side bezel structure 1618 may be integrally formed and may include the same material (e.g., a metal material such as aluminum).

The front plate 1602 may include two first regions 1610D, which are bent toward the rear plate 1611 from the first surface 1610A so as to be seamlessly extended, at opposite long edges of the front plate 1602.

As illustrated in FIG. 16B, the rear plate 1611 may include two second regions 1610E, which are bent toward the front plate 1602 from the second surface 1610B to be seamlessly extended, at opposite long edges thereof. The front plate 1602 (or the rear plate 1611) may include only one of the first regions 1610D (or the second regions 1610E). Alternatively, a portion of the first regions 1610D or the second regions 1610E may not be included. When viewed from the side surface of the electronic device 1600, the side bezel structure 1618 may have a first thickness (or width) on one side where the first region 1610D or the second region 1610E are not included, and may have a second thickness on one side where the first region 1610D or the second region 1610E are included. The second thickness may be smaller than the first thickness.

The electronic device 1600 includes a display 1601, audio modules 1603, 1607, and 1614, sensor modules 1604, 1616, and 1619, camera modules 1605, 1612, and 1613, key input devices 1617, a light-emitting device 1606, and connector holes 1608 and 1609). The electronic device 1600 may omit at least one of the illustrated components (e.g., the key input devices 1617 or the light-emitting device 1606) or may further include another component.

The display 1601 may be exposed through a considerable portion of the front plate 1602. At least a part of the display 1601 may be exposed through the first surface 1610A and the front plate 1602 forming the first region 1610D of the side surface 1610C. A corner of the display 1601 may be formed to be mostly identical to a shape of an outer portion of the front plate 1602 adjacent thereto. To increase the area at which the display 1601 is exposed, a difference between an outer portion of the display 1601 and an outer portion of the front plate 1602 may be formed mostly identically.

A recess or an opening may be formed in a portion of a screen display region of the display 1601, and at least one or more of the audio module 1614, the sensor module 1604, the camera module 1605, and the light-emitting device 1606 may be provided to be aligned with the recess or the opening. At least one or more of the audio module 1614, the sensor module 1604, the camera module 1605, the fingerprint sensor 1616, and the light-emitting device 1606 may be provided on a back surface of the display 1601, which corresponds to the screen display region. The display 1601 may be combined with a touch sensing circuit, a pressure sensor capable of measuring the intensity (or pressure) of a touch, and/or a digitizer capable of detecting a magnetic stylus pen or may be disposed adjacent thereto. At least a part of the sensor modules 1604 and 1619 and/or at least part of the key input devices 1617 may be disposed in the first region 1610D and/or the second region 1610E.

The audio modules 1603, 1607, and 1614 may include a microphone hole 1603 and speaker holes 1607 and 1614. A microphone for obtaining external sound may be disposed inside the microphone hole 1603. A plurality of microphones may be disposed inside the microphone hole 1603. The speaker holes 1607 and 1614 may include an external speaker hole 1607 and a receiver hole 1614 for making a call. The speaker holes 1607 and 1614 and the microphone hole 1603 may be implemented with one hole, or a speaker (e.g., a piezo speaker) may be included without the speaker holes 1607 and 1614.

The sensor modules 1604, 1616, and 1619 may generate an electrical signal or a data value corresponding to an internal operation state of the electronic device 1600 or corresponding to an external environment state. The sensor modules 1604, 1616, and 1619 may include, for example, a first sensor module 1604 (e.g., a proximity sensor) and/or a second sensor module (e.g., a fingerprint sensor) disposed on the first surface 1610A of the housing 1610, and/or a third sensor module 1619 (e.g., a hear rate monitor (HRM) sensor) and/or a fourth sensor module 1616 (e.g., a fingerprint sensor) disposed on the second surface 1610B of the housing 1610. The fingerprint sensor may be positioned on the second surface 1610B and the first surface 1610A (e.g., the display 1601) of the housing 1610.

The electronic device 1600 may further include a sensor module not illustrated, e.g., a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, and/or an illumination sensor 1604.

The camera modules 1605, 1612, and 1613 may include a first camera device 1605 disposed on the first surface 1610A of the electronic device 1600, and a second camera device 1612 and/or a flash 1613 disposed on the second surface 1610B. The camera modules 1605 and 1612 may include one or more lenses, an image sensor, and/or an ISP. The flash 1613 may include a light emitting diode or a xenon lamp. Two or more lenses (e.g., an infrared camera and wide-angle and telephoto lenses) and image sensors may be disposed on one surface of the electronic device 1600.

The key input devices 1617 may be disposed on the side surface 1610C of the housing 1610. Alternatively, the electronic device 1600 may not include all or a part of the key input devices 1617, and a key input device 1617 not included may be implemented on the display 1601 in the form of a soft key. A key input device may include the sensor module 1616 disposed on the second surface 1610B of the housing 1610.

The light-emitting device 1606 may be disposed on the first surface 1610A of the housing 1610. The light-emitting device 1606 may provide status information of the electronic device 1600, e.g., in the form of light. The light-emitting device 1606 may provide a light source that operates in conjunction with an operation of the camera module 1605. The light-emitting device 1606 may include a light-emitting diode (LED), an IR LED, and a xenon lamp.

The connector holes 1608 and 1609 may include the first connector hole 1608 that is able to accommodate a connector (e.g., a USB connector) for transmitting/receiving a power and/or data with an external electronic device, and/or the second connector hole (or an earphone jack) 1609 that is able to accommodate a connector for transmitting/receiving an audio signal with the external electronic device.

Figure 16C:
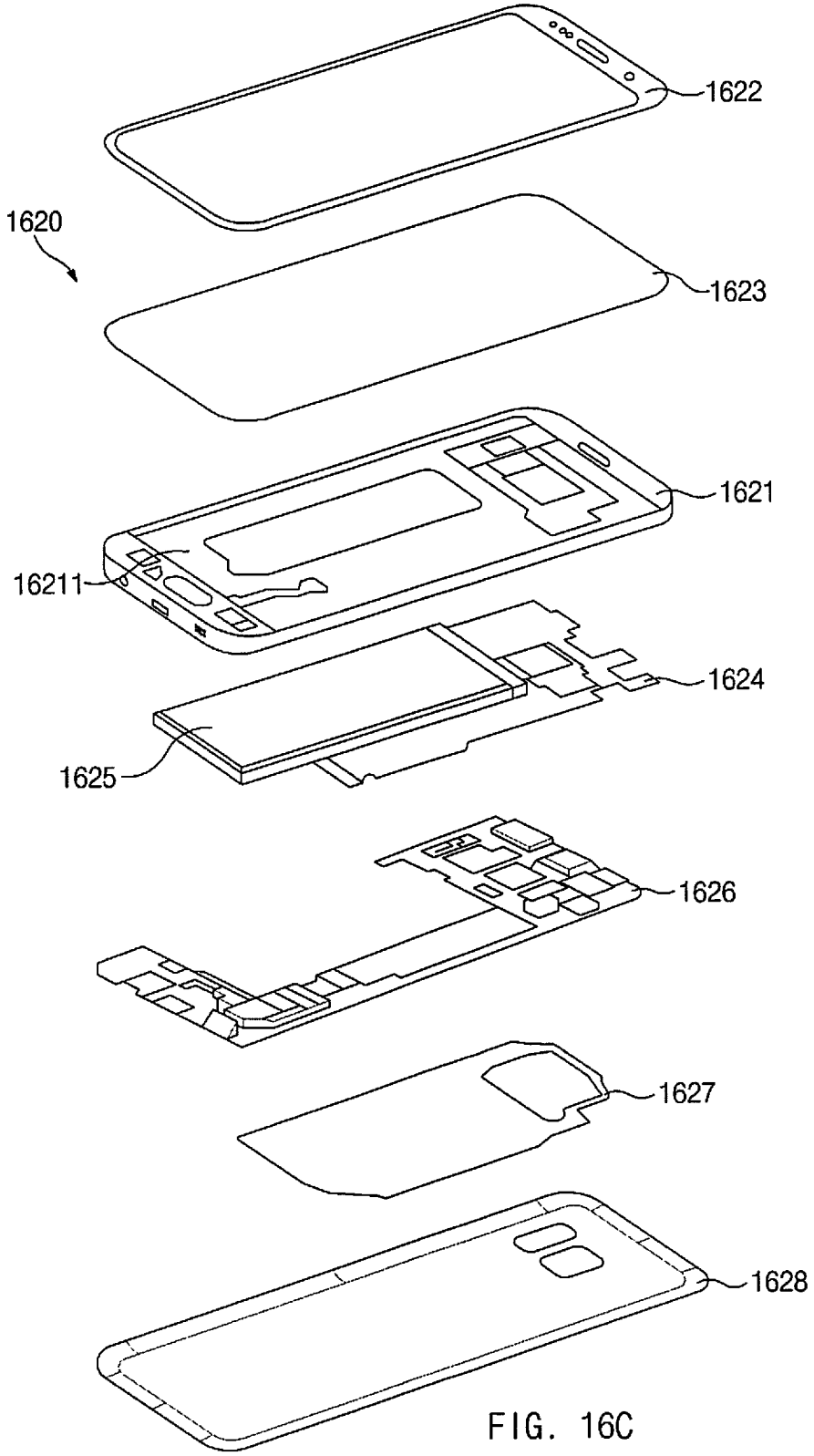
FIG. 16C illustrates an exploded perspective view of a mobile electronic device, according to an embodiment.

FIG. 16C illustrates an exploded perspective view of a mobile electronic device, according to an embodiment.

Referring to FIG. 16C, a mobile electronic device 1620 includes a side bezel structure 1621, a first support member 16211 (e.g., a bracket), a front plate 1622, a display 1623, a PCB 1624, a battery 1625, a second support member 1626 (e.g., a rear case), an antenna 1627, and a rear plate 1628. Alternatively, the electronic device 1620 may omit at least one of the components (e.g., the first support member 16211 or the second support member 1626) or may further include another component. At least one of the components of the electronic device 1620 may be similar to or the same as at least one of the components of the electronic device 1600 of FIG. 16A or 16B. Thus, additional description will be omitted to avoid redundancy.

The first support member 16211 may be disposed inside the electronic device 1620, and may be connected to the side bezel structure 1621 or may be integrally formed with the side bezel structure 1621. The first support member 16211 may be formed of a metal material and/or a nonmetal material (e.g., a polymer). The display 1623 may be coupled with one surface of the first support member 16211, and the PCB 1624 may be coupled with an opposite surface of the first support member 311. A processor, a memory, and/or an interface may be mounted on the PCB 1624. The processor may include one or more of a CPU, an AP, a GPU, an ISP, a sensor hub processor, or a CP.

The memory may include a volatile memory or a non-volatile memory.

The interface may include an HDMI, a USB interface, an SD card interface, and/or an audio interface. The interface may electrically or physically connect the electronic device 1620 to an external electronic device and may include a USB connector, an SD card/MMC connector, or an audio connector.

The battery 1625 may supply power to at least one component of the electronic device 1620 and may include a primary cell incapable of being recharged, a secondary cell rechargeable, and/or a fuel cell. At least part of the battery 1625 may be disposed on substantially the same plane as the PCB 1624, for example. The battery 1625 may be integrally disposed within the electronic device 1620, or may be disposed to be removable from the electronic device 1620.

The antenna 1627 may be interposed between the rear plate 1628 and the battery 1625. The antenna 1627 may include a near field communication (NFC) antenna, an antenna for wireless charging, and/or a magnetic secure transmission (MST) antenna. The antenna 1627 may perform short range communication with an external device or may wirelessly transmit/receive power for charging. An antenna structure may be formed by a part of the side bezel structure 1621 and/or the first support member 16211, or by a combination thereof.

Figure 17:
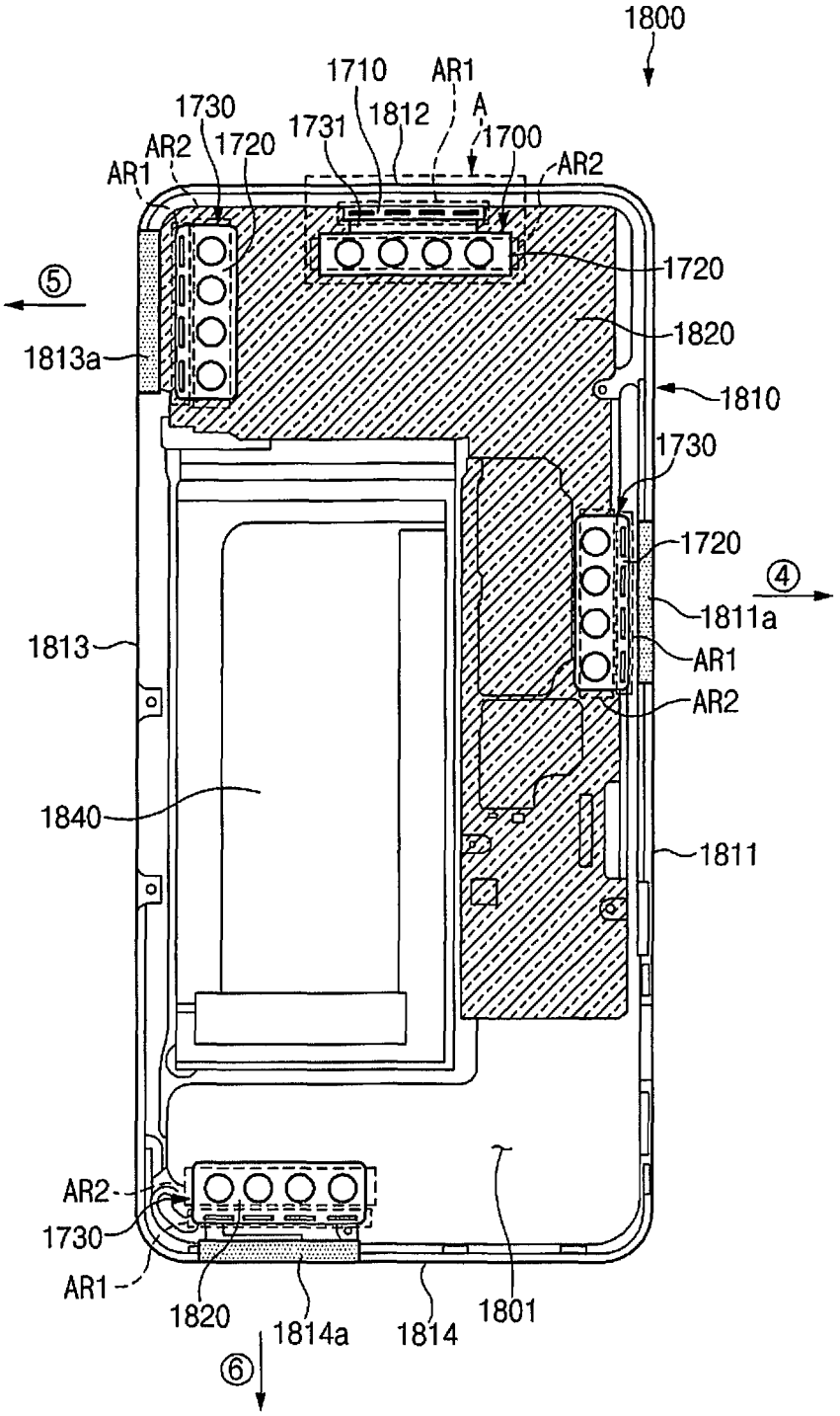
FIG. 17 illustrates antenna modules arranged in an electronic device, according to an embodiment.

FIG. 17 illustrates antenna modules arranged in an electronic device, according to an embodiment.

Referring to FIG. 17, an electronic device 1800 includes a side surface member 1810. The side surface member 1810 includes a first side surface 1811 formed to have a first length, a second side surface 1812 extending in a direction perpendicular to a first side surface 1811 and having a second length shorter than the first length, a third side surface 1813 extending in a direction parallel to the first side surface 1811 from the second side surface 1812 and having the first length, and a fourth side surface 1814 extending in a direction parallel to the second side surface 1812 from the third side surface 1813 and having the second length. The electronic device 1800 includes a battery 1840 and a device substrate 1820, which is disposed in an inner space 1801, avoiding or at least partially overlapping the battery 1840. The first antenna module 1700 and the second antenna modules 1730 may be arranged in various directions in the inner space 1801 and may be electrically connected to the device substrate 1820.

The first antenna module 1700 may be disposed at the periphery of the second side surface 1812. The plurality of second antenna modules 1730 may be arranged at the periphery of the first side surface 1811, at the periphery of the third side surface 1813, and/or at the periphery of the fourth side surface 1814. A first antenna array AR1 of the second antenna module 1830 at the periphery of the first side surface 1811 may form a beam pattern in a direction (④ direction), in which the first side surface 1811 faces, through a first non-conductive region 1811*a* partially formed on the first side surface 1811. A second antenna array AR2 may form a beam pattern in a direction, in which a rear surface plate of the electronic device 1800 faces. A third antenna array AR1 of the second antenna module 1730 at the periphery of the third side surface 1813 may form a beam pattern in a direction (⑤ direction), in which the third side surface 1813 faces, through a second non-conductive region 1813*a* partially formed on the third side surface 1813. A second antenna array AR2 may form a beam pattern in a direction, in which a rear surface plate of the electronic device 1800 faces. The first antenna array AR1 of the second antenna module 1730 at the periphery of the fourth side surface 1814 may form a beam pattern in a direction (⑥ direction), in which the fourth side surface 1814 faces, through a third non-conductive region 1814*a* partially formed on the third side surface 1814. A second antenna array AR2 may form a beam pattern in a direction, in which a rear surface plate of the electronic device 1800 faces.

Unlike the second antenna module 1730, the first antenna array AR1 of the first antenna module 1700 disposed at the periphery of the second side surface 1812 may form a beam pattern in a direction, in which the front surface plate of an electronic device faces. A second antenna array AR2 may form a beam pattern in a direction, in which a rear surface plate of the electronic device 1800 faces. In this case, the beam coverage in a direction in which the front surface plate faces may be secured using the first antenna array AR1.

According to an embodiment, an electronic device may include a housing. The housing may include a first plate, a second plate facing away from the first plate, and a side member surrounding a space between the first plate and the second plate and coupled with the second plate or integrally formed with the second plate. The electronic device may include a display viewable through at least part of the first plate and an antenna structure disposed inside the housing and including a first surface facing a first direction and a second surface facing a direction (e.g., −z direction of FIG. 5) opposite to the first direction. When viewed from above the first surface, the antenna structure may include a first region including a periphery extending in a second direction perpendicular to the first direction and including at least one ground layer and a second region contacting the periphery. When viewed from above the first surface, the antenna structure may include a first dipole antenna extending in the second direction and spaced from the periphery, within the second region, a second dipole antenna extending in the second direction between the periphery and the first dipole antenna, and at least one conductive pattern interposed between the periphery and the second dipole antenna. The antenna structure may include at least one wireless communication circuit electrically connected to at least one of the first dipole antenna or the second dipole antenna and configured to transmit and/or receive a signal having a frequency between 3 GHz and 100 GHz.

When viewed from above the first surface, the ground layer may include a first protrusion part protruding in a third direction perpendicular to the second direction from one end of the periphery and a second protrusion part protruding in the third direction from another end of the periphery. The first protrusion part, the periphery, and the second protrusion part may form a recess. A length of the periphery between the first protrusion part and the second protrusion part may be longer than a length of the first dipole antenna and/or the second dipole antenna in the second direction.

When viewed from above the first surface, the antenna structure may include at least one conductive line, which extends in a third direction perpendicular to the second direction from the first region to the second region and which is electrically connected to the first dipole antenna and the second dipole antenna. The at least one conductive line may include a first conductive line and a second conductive line.

When viewed from above the first surface, the first dipole antenna may include a first conductive strip extending in the second direction from the first conductive line and a second conductive strip, which is aligned with the first conductive strip in a fourth direction opposite to the second direction and which extends from the second conductive line.

When viewed from above the first surface, the second dipole antenna may include a third conductive strip extending in the second direction from the first conductive line and a fourth conductive strip, which is aligned with the third conductive strip in the fourth direction and which extends from the second conductive line.

For example, each of the first conductive strip and the second conductive strip may have a first length, and each of the third conductive strip and the fourth conductive strip may have a second length different from the first length.

When viewed from above the first surface, the conductive pattern may include a first conductive pattern extending in the second direction from the first conductive line and a second conductive pattern, which is aligned with the first conductive pattern in a fourth direction opposite to the second direction and which extends from the second conductive line.

When viewed from above the first surface, the antenna structure further may further include a conductive plate disposed inside the first region and on at least part of the first surface and electrically connected to the at least one wireless communication circuit.

According to an embodiment, an electronic device includes a housing. The housing may include a first plate, a second plate facing away from the first plate, and a side member surrounding a space between the first plate and the second plate and coupled with the second plate or integrally formed with the second plate. The electronic device may include a display viewable through at least part of the first plate and an antenna structure disposed inside the housing and including a first surface facing a first direction and a second surface facing a direction opposite to the first direction.

When viewed from above the first surface, the antenna structure may include a first region including a periphery extending in a second direction perpendicular to the first direction and including at least one ground layer and a second region contacting the periphery. The antenna structure may include at least one dipole antenna extending in the second direction and spaced from the periphery, within the second region. The antenna structure may include a conductive pattern interposed between the periphery and the at least one dipole antenna. The antenna structure may include at least one wireless communication circuit electrically connected to the at least one dipole antenna and configured to transmit and/or receive a signal having a frequency between 3 GHz and 100 GHz.

According to the above-described embodiments, the size of an antenna module included in an electronic device may be reduced, and a variety of effects directly or indirectly understood through the disclosure may be provided.

While the disclosure has been shown and described with reference to certain embodiments thereof, it will be understood by those skilled in the art that various changes in form and details may be made therein without departing from the spirit and scope of the disclosure as defined by the appended claims and their equivalents.

What is claimed is:

1. An electronic device, comprising:

a housing including a first plate, a second plate facing away from the first plate, and a side member surrounding a space between the first plate and the second plate;

a display;

an antenna structure disposed inside the housing, wherein the antenna structure includes:

a first surface facing a first direction, a second surface facing a direction opposite to the first direction, when viewed from above the first surface, a first region including a ground layer, the ground layer including a periphery extending in a second direction perpendicular to the first direction, a first protrusion part protruding in a third direction perpendicular to the second direction from one end of the periphery, and a second protrusion part protruding in the third direction from another end of the periphery, a second region contacting the periphery, the first protrusion part, and the second protrusion part, when viewed from above the first surface, a first dipole antenna extending in the second direction and spaced from the periphery, within the second region, a second dipole antenna extending in the second direction between the periphery and the first dipole antenna, a patch antenna disposed inside the first region on at least a part of the first surface, and a conductive pattern interposed between the periphery and the second dipole antenna; and a wireless communication circuit electrically connected to the first dipole antenna, the second dipole antenna, and the patch antenna, wherein the wireless communication circuit is configured to transceive signals having frequencies between 3 GHz and 100 GHz, and wherein the first protrusion part, the periphery, and the second protrusion part form a recess of the first region.

2. The electronic device of claim 1, wherein a length of the periphery between the first protrusion part and the second protrusion part is longer than a length of the first dipole antenna or the second dipole antenna in the second direction.

3. The electronic device of claim 1, wherein, when viewed from above the first surface, the antenna structure further includes a conductive line that extends in the third direction perpendicular to the second direction from the first region to the second region and that is electrically connected to the first dipole antenna and the second dipole antenna.

4. The electronic device of claim 3, wherein the conductive line includes a first conductive line and a second conductive line.

5. The electronic device of claim 4, wherein, when viewed from above the first surface, the first dipole antenna includes:

a first conductive strip extending in the second direction from the first conductive line; and a second conductive strip, which is aligned with the first conductive strip in a fourth direction opposite to the second direction, and which extends from the second conductive line.

6. The electronic device of claim 5, wherein, when viewed from above the first surface, the second dipole antenna includes:

a third conductive strip extending in the second direction from the first conductive line; and a fourth conductive strip, which is aligned with the third conductive strip in the fourth direction, and which extends from the second conductive line.

7. The electronic device of claim 6, wherein each of the first conductive strip and the second conductive strip has a first length, and wherein each of the third conductive strip and the fourth conductive strip has a second length different from the first length.

8. The electronic device of claim 4, wherein, when viewed from above the first surface, the conductive pattern includes:

a first conductive pattern extending in the second direction from the first conductive line; and a second conductive pattern aligned with the first conductive pattern in a fourth direction opposite to the second direction, and extending from the second conductive line.

9. An electronic device, comprising:

a housing including a first plate, a second plate facing away from the first plate, and a side member surrounding a space between the first plate and the second plate;

a display;

an antenna structure disposed inside the housing, wherein the antenna structure includes:

a first surface facing a first direction, a second surface facing a direction opposite to the first direction, when viewed from above the first surface, a first region including a ground layer, the ground layer including a periphery extending in a second direction perpendicular to the first direction, a first protrusion part protruding in a third direction perpendicular to the second direction from one end of the periphery, and a second protrusion part protruding in the third direction from another end of the periphery, a second region contacting the periphery, the first protrusion part, and the second protrusion part, a dipole antenna extending in the second direction and spaced from the periphery, within the second region, a patch antenna disposed inside the first region on at least a part of the first surface, and a conductive pattern interposed between the periphery and the dipole antenna; and a wireless communication circuit electrically connected to the dipole antenna and the patch antenna, wherein the wireless communication circuit is configured to transceive signals having frequencies between 3 GHz and 100 GHz, wherein the first protrusion part, the periphery, and the second protrusion part form a recess of the first region.

10. The electronic device of claim 9, wherein a length of the periphery between the first protrusion part and the second protrusion part is longer than a length of the dipole antenna in the second direction.

11. The electronic device of claim 9, wherein, when viewed from above the first surface, the antenna structure further includes a conductive line, which extends in the third direction perpendicular to the second direction from the first region to the second region, and which is electrically connected to the dipole antenna.

12. The electronic device of claim 11, wherein the conductive line includes a first conductive line and a second conductive line.

13. The electronic device of claim 12, wherein the dipole antenna includes a first dipole antenna and a second dipole antenna, and wherein, when viewed from above the first surface, the first dipole antenna includes:

a first conductive strip extending in the second direction from the first conductive line; and a second conductive strip, which is aligned with the first conductive strip in a fourth direction opposite to the second direction, and which extends from the second conductive line.

14. The electronic device of claim 13, wherein, when viewed from above the first surface, the second dipole antenna includes:

a third conductive strip extending in the second direction from the first conductive line; and a fourth conductive strip, which is aligned with the third conductive strip in the fourth direction, and which extends from the second conductive line.

15. The electronic device of claim 14, wherein each of the first conductive strip and the second conductive strip has a first length, and wherein each of the third conductive strip and the fourth conductive strip has a second length different from the first length.

16. The electronic device of claim 12, wherein, when viewed from above the first surface, the conductive pattern includes:

a first conductive pattern extending in the second direction from the first conductive line; and a second conductive pattern aligned with the first conductive pattern in a fourth direction opposite to the second direction, and extending from the second conductive line.

* * * * *